United States Patent [19]

Chu

[11] 4,125,336

[45] Nov. 14, 1978

[54] DOT MATRIX PRINTER

[75] Inventor: Ge Y. Chu, Lincoln, Mass.

[73] Assignee: Wang Laboratories, Inc., Lowell, Mass.

[21] Appl. No.: 765,079

[22] Filed: Feb. 3, 1977

Related U.S. Application Data

[62] Division of Ser. No. 675,205, Apr. 8, 1976, abandoned.

[51] Int. Cl.[2] ..... B41J 3/12

[52] U.S. Cl. ..... 400/124; 101/93.05

[58] Field of Search ..... 197/1 R; 101/93.05; 400/124

[56] References Cited

U.S. PATENT DOCUMENTS

| | | | |
|---|---|---|---|
| 3,831,729 | 8/1974 | Howard | 197/1 R |
| 3,850,278 | 11/1974 | Mihm et al. | 197/1 R |
| 3,940,726 | 2/1976 | Gershnow | 197/1 R X |
| 3,994,382 | 11/1976 | McIntosh | 197/1 R |
| 4,046,244 | 9/1977 | Velazquez | 197/1 R |

*Primary Examiner*—Paul T. Sewell

[57] ABSTRACT

A dot matrix printer including a dot matrix print head assembly including a plurality of thin, elongated print wires having printing end surfaces, and a bearing member for supporting the print wires adjacent their printing end surfaces. The bearing member has a plurality of bearing apertures, with the printing wire end surfaces extendable therethrough to print on a document. The apertures have their centers aligned along parallel axes defining leading and trailing sets of print wires, the center of each of the apertures aligned with one axis being located parallel to a point between two adjacent ones of the apertures aligned with the other axis. The control means causes selected ones of the leading set of print wires to print at a particular column position, and thereafter causes selected ones of the trailing set of print wires to print at the same column position.

2 Claims, 54 Drawing Figures

TIMING OF LINE INPUT FROM CPU 12 (132 CHARACTERS)

TIMING OF CHARACTER INPUT FROM CPU 12

CHARACTER PRINT TIMING

SERVO MOTOR CONTROL TIMING

MASTER CLOCK
(CARD 6576)

PRIME BLOCK
(CARD 6576)

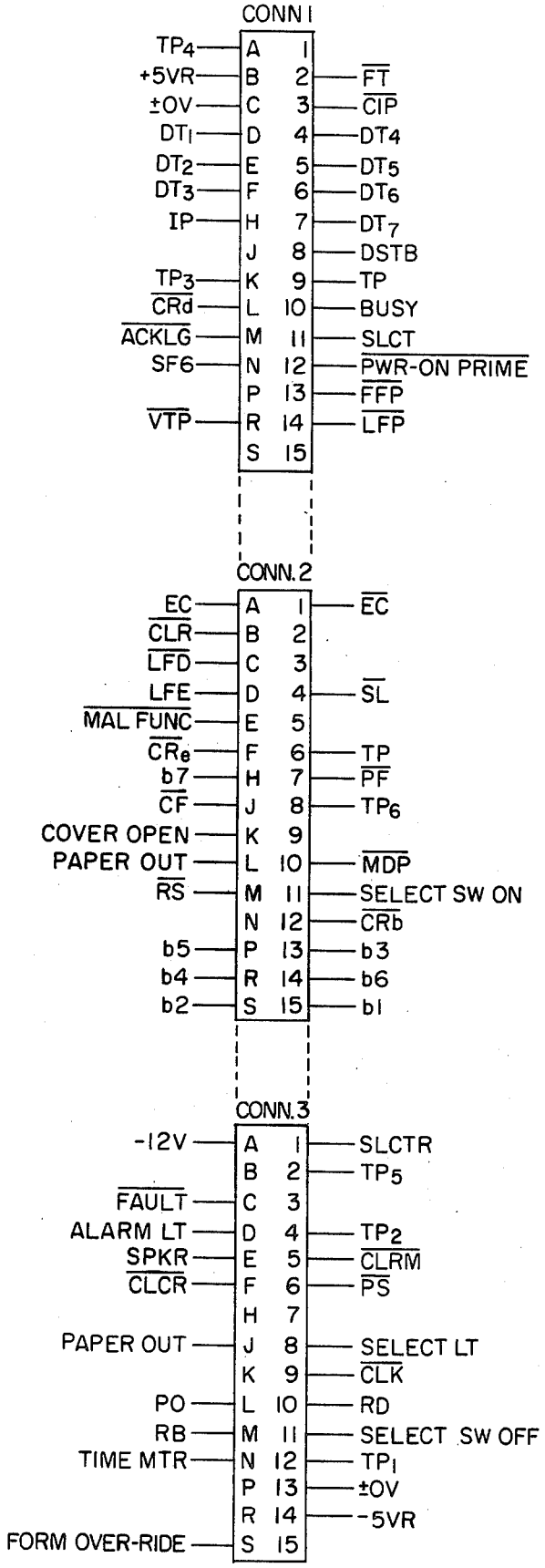
CONNECTOR DESIGNATIONS
(CARD 6576) FIG 21
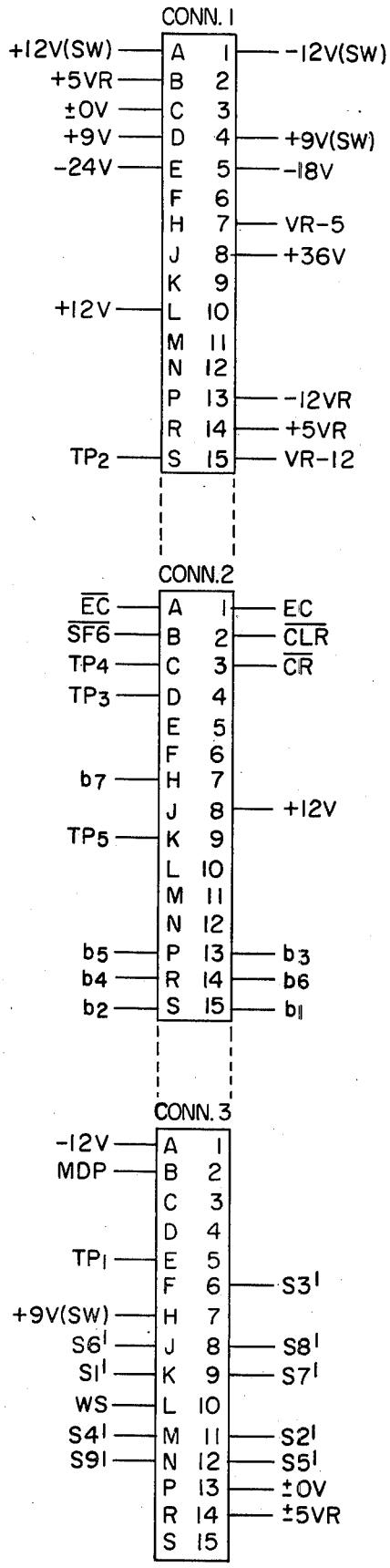
CONNECTOR DESIGNATIONS
FIG 26 (CARD 6728)

CHARACTER MATRIX
GENERATOR BLOCK
(CARD 6728)

SOLENOID DRIVER BLOCK
(CARD 6728)

CHARACTER GENERATING
TIMING BLOCK
(CARD 6728)

24-2
24-3
24-4
24-5
24-6
24-7
24-8
24-9
24-10
24-11
24-12
LOAD ODD
LOAD EVEN
FIRE ODD
FIRE EVEN
COUNTER
FF
F F
PG
(FIRE ODD)'
(FIRE EVEN)'
CRA
AR
680 pf
330 pf
2.2 K
4700 pf
.002 μf
.0068 μf
.02 μf
.1 μf
22 K
4.7 K
25 K
25K
+5VR
±0V
SF6
CLR
EC
CRe
MDP
WS
K2
C2
D2
S1
B2
A2
B3
L3

POWER SUPPLY
(CARD 6728)

OPTICAL SENSOR SIGNAL BLOCK (CARD 6577)

RIBBON DRIVER BLOCK (CARD 6577)

SERVO MOTOR CONTROL BLOCK (B) (CARD 6577)

PAPER FEED DRIVER BLOCK (CARD 6577)

FORMAT CONTROL BLOCK
(CARD 6577)

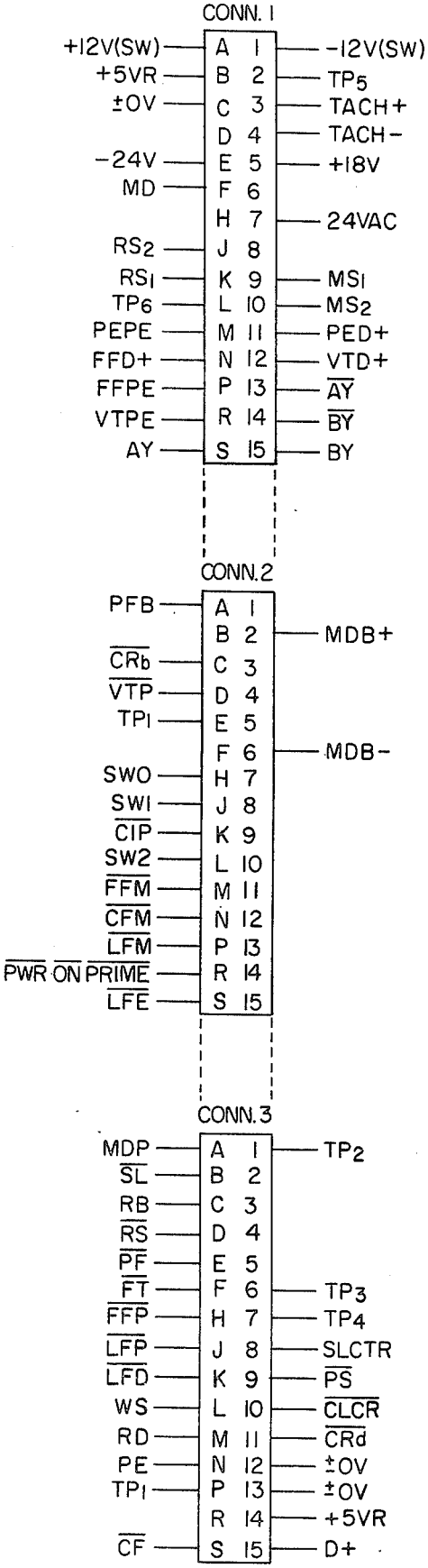
CONNECTOR DESIGNATIONS
(CARD 6577) FIG 33
TP= TEST POINT
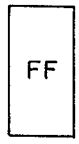
FLIP FLOP
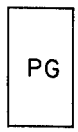
PULSE GENERATOR
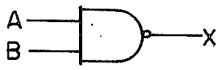
NAND GATE
| A | B | X |
|---|---|---|
| 1 | 1 | 0 |
| 1 | 0 | 1 |
| 0 | 1 | 1 |
| 0 | 0 | 1 |
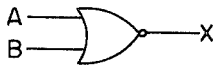
NOR GATE
| A | B | X |
|---|---|---|
| 1 | 1 | 0 |
| 1 | 0 | 0 |
| 0 | 1 | 0 |
| 0 | 0 | 1 |
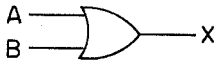
OR GATE
| A | B | X |
|---|---|---|
| 1 | 1 | 1 |
| 1 | 0 | 1 |
| 0 | 1 | 1 |
| 0 | 0 | 0 |
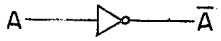
INVERTOR
SYMBOLS USED IN FIGS 15 TO 32
FIG 47

FIRE ODD
LOAD ODD
LOAD EVEN
FIRE EVEN
145
147-2
148

1234567890---=!@#$%^&*()--+ABCDEFGHIJKLMNOPQRSTUVWXYZabcdefghijklmnopqrstuvwxyz

FIG 46

DOT MATRIX PRINTER

This application is a division of Ser. No. 675,205, filed Apr. 8, 1976, entitled "Dot Matrix Printer," now abandoned.

This invention relates to printers of the general type known as dot matrix printers. The print head of such a printer provides a plurality of thin, elongated print wires, each fired by a solenoid. The printing end surfaces of the wires either strike the paper through an inked ribbon, or they may strike a pressure-sensitive paper directly. In either case, each printed character is built up from an array of printed dots. Conventional dot-matrix printers commonly provide a vertically aligned column of wires, and print selected ones of these wires in each successive column to build up the character matrix. A printer of this general type is disclosed in U.S. Pat. No. 3,703,949, issued Nov. 28, 1972.

In printing dot matrix characters with a printer employing an array of print wires, it is desirable to have the print wires closely spaced, in order to build up the printed character with closely spaced printed dots. The more closely spaced are the dots, the more legible and clear is the character. Preferably, the printed dots should touch or even overlap slightly, giving the effect of a solid line.

However, if it is attempted to print each vertical portion of a character with a single column of print wires, and at the same time to space the print wires very closely, it becomes impossible to surround each print wire with a continuous circular bearing. Rather it is necessary to employ a split bearing of the type disclosed, for example, in U.S. Pat. No. 3,833,105 (for a print head suitable for use with the printer of U.S. Pat. No. 3,703,949), and illustrated in FIG. 1*e* thereof. The bearing of that patent is constructed in two halves, each having seven bearing surfaces of slightly less than a semi-circle. The bearing surfaces are positioned adjacent one another, without quite meeting, and together provide seven bearings for the print wires.

This type of bearing is referred to as a "jewel" bearing because it must be made of an extremely hard and wear-resisting material, preferably sapphire. Such bearings are expensive. Futhermore, when a split bearing is used, the printed dots cannot be made to overlap.

It is desirable, therefore, to provide a bearing for a dot-matrix print head that does not require expensive materials for its construction, and that permits closely spaced or overlapping dots to be printed.

In addition, because all the print wires in this type of print head must converge into a single vertical column, the angle of each wire as it enters the bearing must be relatively acute, which decreases the life of the wire. At the same time, the bearing must be thin, and it is therefore easily broken; each bearing aperture also presents a narrow, relatively sharp edge to the print wire passing through it, which increases wear on the print wire.

Therefore, it is desirable to provide a bearing that reduces wear on the print wires and extends their useful life.

Accordingly, the present invention, in its major aspect, provides a dot matrix printer including a dot matrix print head assembly providing a plurality of thin, elongated print wires having printing end surfaces, and a bearing member for supporting the print wires adjacent their printing end surfaces. The bearing member has a plurality of bearing apertures, the print wires being supported by the bearing surfaces and the printing end surfaces being extendable therethrough to print on a document or other record. In a preferred embodiment, the apertures have their centers aligned along parallel axes, the center of each of the apertures aligned with one axis being located parallel to a point between two adjacent ones of the apertures aligned with the other axis.

Print head travel detection means are provided for moving the print head relative to a document or other record to be printed. Such means provides a travel signal representative of travel relative to the record through a distance equal to the spacing of the axes and defines successive column positions. The apertures aligned with one axis arrive at a particular column position before the apertures aligned with the other said axis and so constitute a leading set of apertures. The remaining apertures constitute a trailing set of apertures. The print wires supported by the leading set of apertures constitute a leading set of print wires, and the print wires supported by the trailing set of apertures constitute a trailing set of print wires. Print control means responsive to the travel signal causes selected ones of the leading set of print wires to print at a column position, and causes selected ones of the trailing set of print wires thereafter to print at the same column position.

Preferably, the bearing member axes are spaced apart by a distance of the order of the aperture diameter, the apertures aligned along a said axis are spaced apart equally along the axis by a distance of at least the order of the aperture diameter and the center of each of the apertures aligned with one axis are located parallel to a point-half the distance between two adjacent ones of the apertures aligned with the other axis.

The bearing member is desirably of one piece construction with a plurality of spaced, discrete bearing apertures having integral circular bearing surfaces. Also, the bearing member should have a plurality of at least three bearing apertures along each axis.

In another aspect, the invention provides novel wire drive means for each of the print wires. Such means includes a housing having a central opening extending from the front to the rear of the housing, an enlarged hollow, annular shaped opening surrounding a rearward portion of the central opening and an annular shaped coil assembly positioned within the annular shaped opening and surrounding the rearward portion of the central opening.

A novel cylinder shaped, hollow armature is positioned for reciprocating movement within the rearward portion of the central opening so that at least a portion thereof is surrounded by the coil assembly, the armature having a central through bore enlarged in its forward portion for a substantial distance toward the rearward end thereof. The rearward portion of each of the print wires extends into the forward end of the central opening of an associated housing, through the armature and it joined to the rear end of the armature. A biasing member is also secured to the rear end of the armature, such biasing member normally urging the armature in the rearward direction when the coil assembly is deenergized.

Preferably, a hollow, cylinder shaped core element of magnetic material is positioned within the forward portion of the central opening so that at least a portion of it is surrounded by the coil assembly.

DESCRIPTION OF THE DRAWINGS

FIG. 21 shows the designations of the connectors of Card 6576;

FIG. 26 shows the designations of the connectors of Card 6728;

FIG. 33 shows the designations of the connectors of Card 6577;

FIG. 46 shows examples of characters printed by the printer of the invention;

FIG. 47 shows certain digital logic symbols appearing in the circuit diagrams with their assigned meanings;

Figure 34:
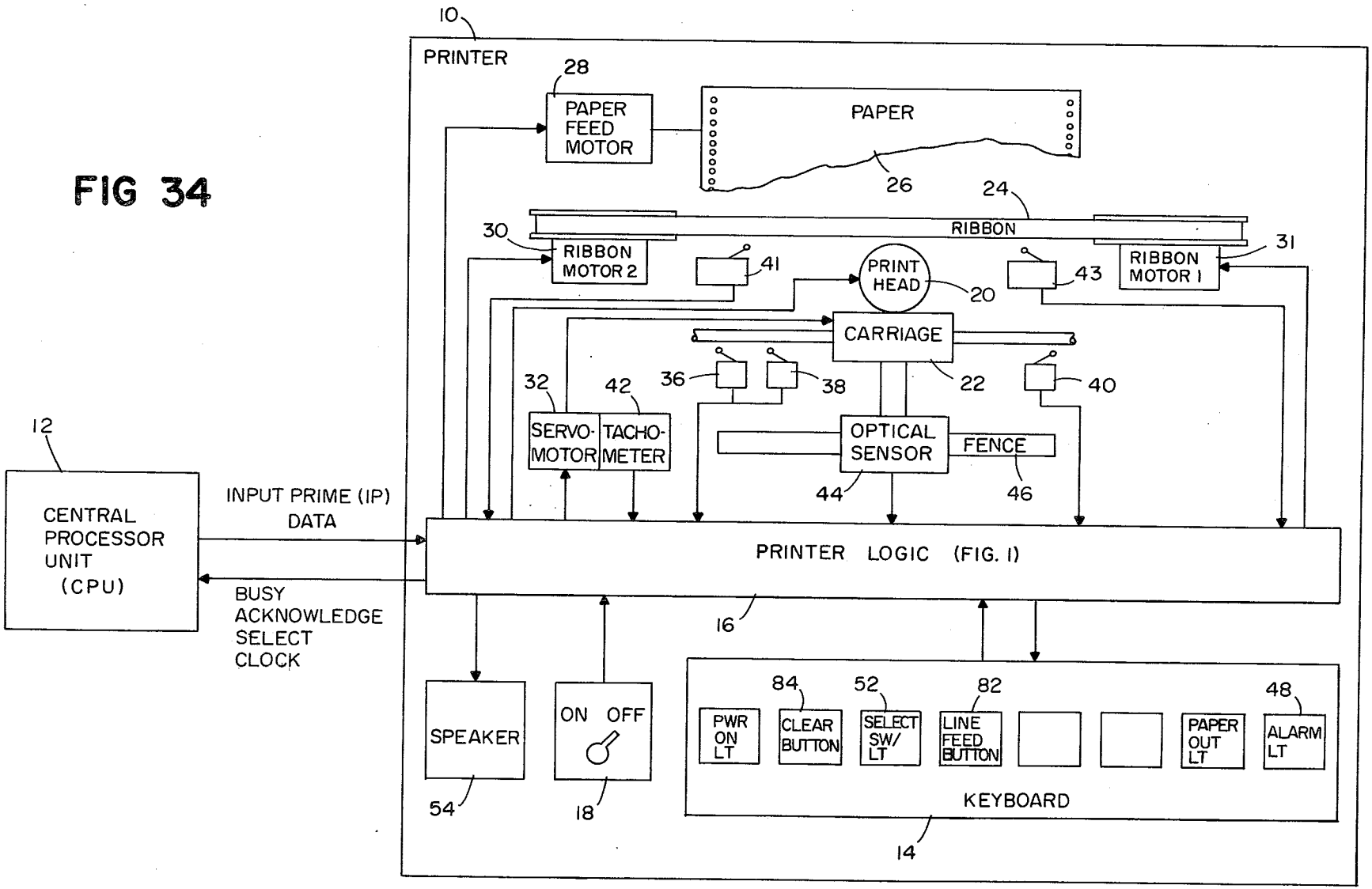
FIG. 34 is a block diagram of the printer of the invention together with a central processor unit.

Referring now particularly to FIG. 34, the printer 10 of the invention is connected to a central processor unit (CPU) 12 or other data source. The operating elements of the printer are a print head 20, carried on a print head carriage 22, which travels horizontally with respect to paper 26. The print head provides 9 solenoid-operated print wires, to be described in more detail in what follows. A ribbon 24 is interposed between print head 20 and paper 26.

The print head 20 of the present invention is shown in FIGS. 48 through 54, and is generally similar to the print head disclosed in U.S. Pat. No 3,833,105, issued Sept. 3, 1974. The print head comprises a head and guide tube assembly 130, which is provided with a cover 132. The print head is secured by screws 134 to the print head carriage 22 (seen in FIG. 34). The print head provides a plurality of thin, elongated print wires that are carried within guide tubes 136. The guide tubes are spaced from one another and maintained in smoothly curved positions by three partitions 140, 142 and 144.

According to the present invention, there are nine print wires, arranged in two columns. One column contains wires 1, 3, 5, 7 and 9, called the "leading" wires; the second contains wires 2, 4, 6 and 8, called the "trailing" wires.

Figure 50:
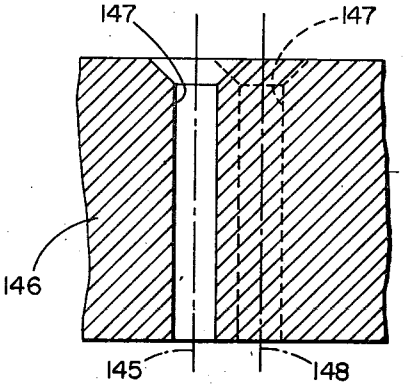
FIG. 50 is a cross section of a portion of the bearing taken along lines 50—50 of FIG. 49.
Figure 49:
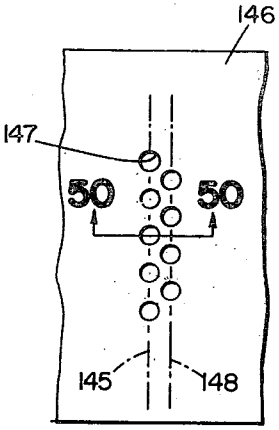
FIG. 49 is a detailed view of a portion of the bearing of the print head according to the invention.

The end of print head 20 is provided with a bearing plate 146, seen in detail in FIGS. 49 and 50. The bearing plate is about 3/32 inch thick, and provides two offset columns of bearing apertures. Each bearing aperture 147 is about 0.0135 inch in diameter, and is flared at an angle of about 45° at the entrance to permit slight flexing of the print wire. Five of the bearing apertures have their centers aligned along a first axis 145, and comprise the "leading" set of apertures; the remaining four bearing apertures have their centers aligned along a second axis 148, and comprise the "trailing" set of apertures. The axes 145 and 148 are parallel and spaced apart by a distance of the order of 0.0182 inch.

The center of each aperture aligned along axis 148 is located parallel to a point one half the distance between the centers of two adjacent ones of the apertures aligned along axis 145. The apertures are therefore positioned in two staggered parallel rows.

Figure 54:
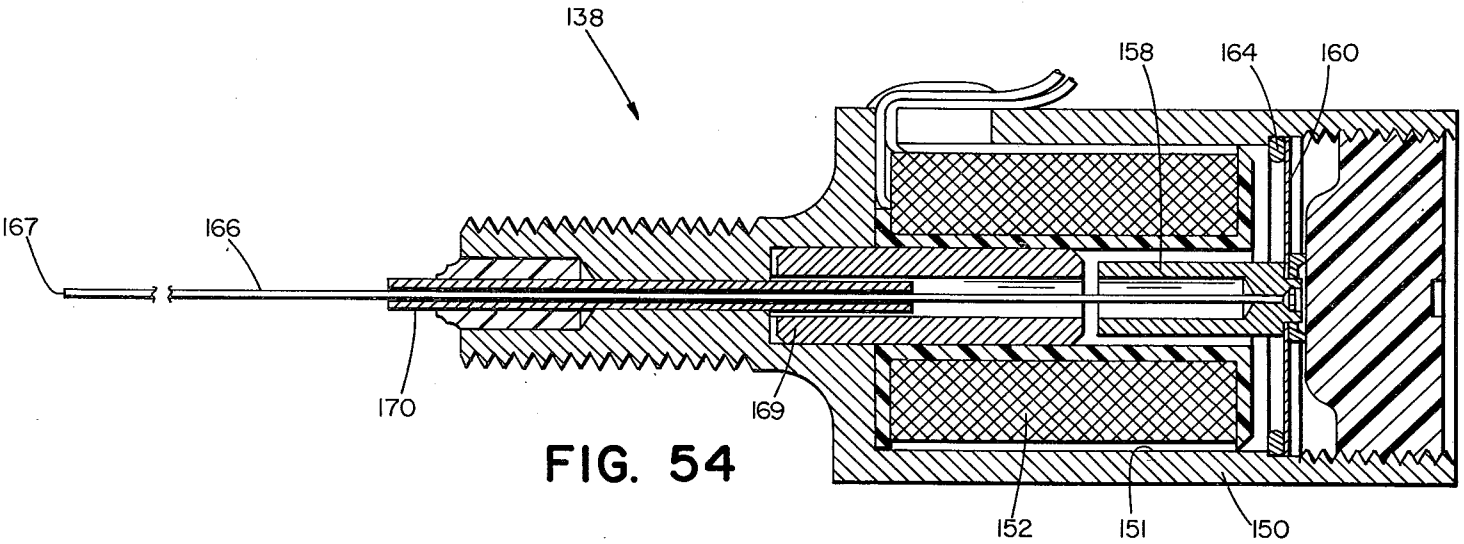
FIG. 54 is a cross section of the print wire solenoid assembly.
Figure 53:
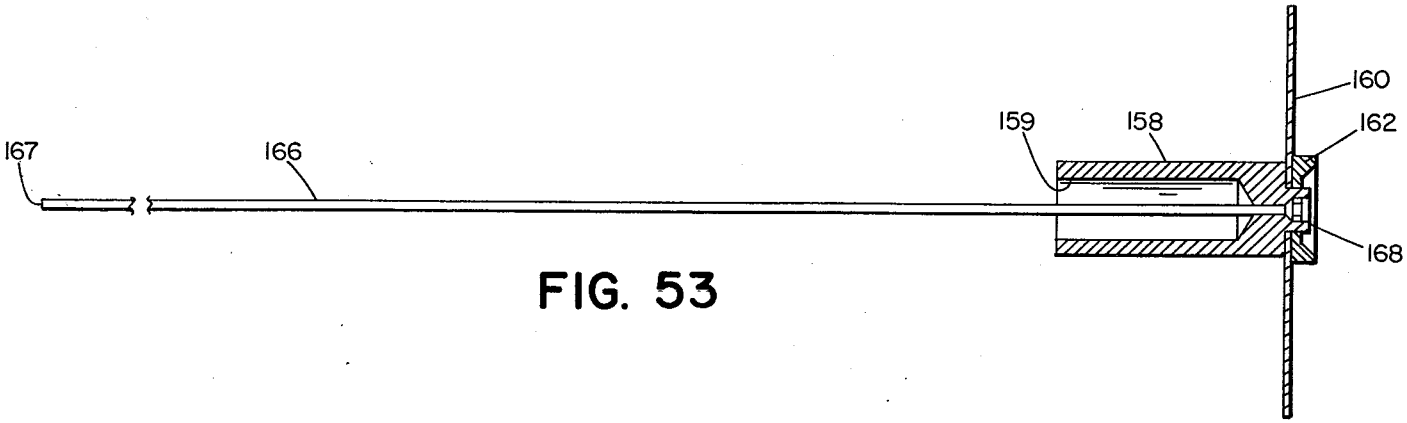
FIG. 53 is a cross section of the armature and print wire of a print wire solenoid assembly according to the invention.

Each print wire is caused to print by a solenoid actuated wire drive device generally designated 138, a cross section thereof being shown in FIG. 54. The wire drive device comprises generally a housing 150 made of magnetizable material and having a central opening 151 extending from the front to the rear of the housing, with an enlarged annular shaped opening surrounding a rearward portion thereof. An annular shaped coil assembly 152 is positioned within the enlarged portion of opening 151 and surrounds its rearward portion.

According to one aspect of the present invention, a hollow, cylindrical shaped armature 158 is positioned for reciprocating movement within the enlarged annular rearward portion of central opening 151 so that at least a portion of said armature is surrounded by coil assembly 152.

More specifically, armature 158 has a central through bore 159 enlarged in its forward portion for a substantial distance toward the rearward end of armature 158. A spring biasing member 160, positioned by a spring retainer 162 and spring spacers 164, normally urges the armature 158 in the rearward direction when coil assembly 152 is deenergized. The print wire 166 extends through hollow armature 158 and is secured to the rear end surface 168 of armature 158 by induction brazing. The print wire 166 is carried in an internal guide tube 170 to the exterior of the solenoid. The printing end surface 167 of print wire 166 is movable through bearing aperture 147 to print paper 26.

The armature 158 is hollow for most of its length, having walls about 0.030 inch thick. As a result, the armature 158 is light, with little inertia and can be moved rapidly to provide rapid and accurate printing. It is made of electrically resistive, highly magnetizable material, such as silicon steel.

In addition, a hollow cylinder-shaped core element, also made of electrically resistive, highly magnetizable material, such as silicon steel, is positioned within the forward portion of central opening 151 so that at least a portion of the core element 169 is surrounded by the coil assembly 152. Such hollow construction of the core element and armature provides much faster magnetic response by the magnetic circuit, because the central material, such has been removed in the construction of the present invention is in effect useless in operating the solenoid because it is surrounded by eddy currents opposing the coil current and hence movement of the armature. Therefore the hollow construction, in both the core element and armature, reduces the eddy currents opposing the magnetic effect of the coil current and hence improves transient response, and reduces the weight of the armature, making it lighter and easier to move.

Printer logic

Figure 1:
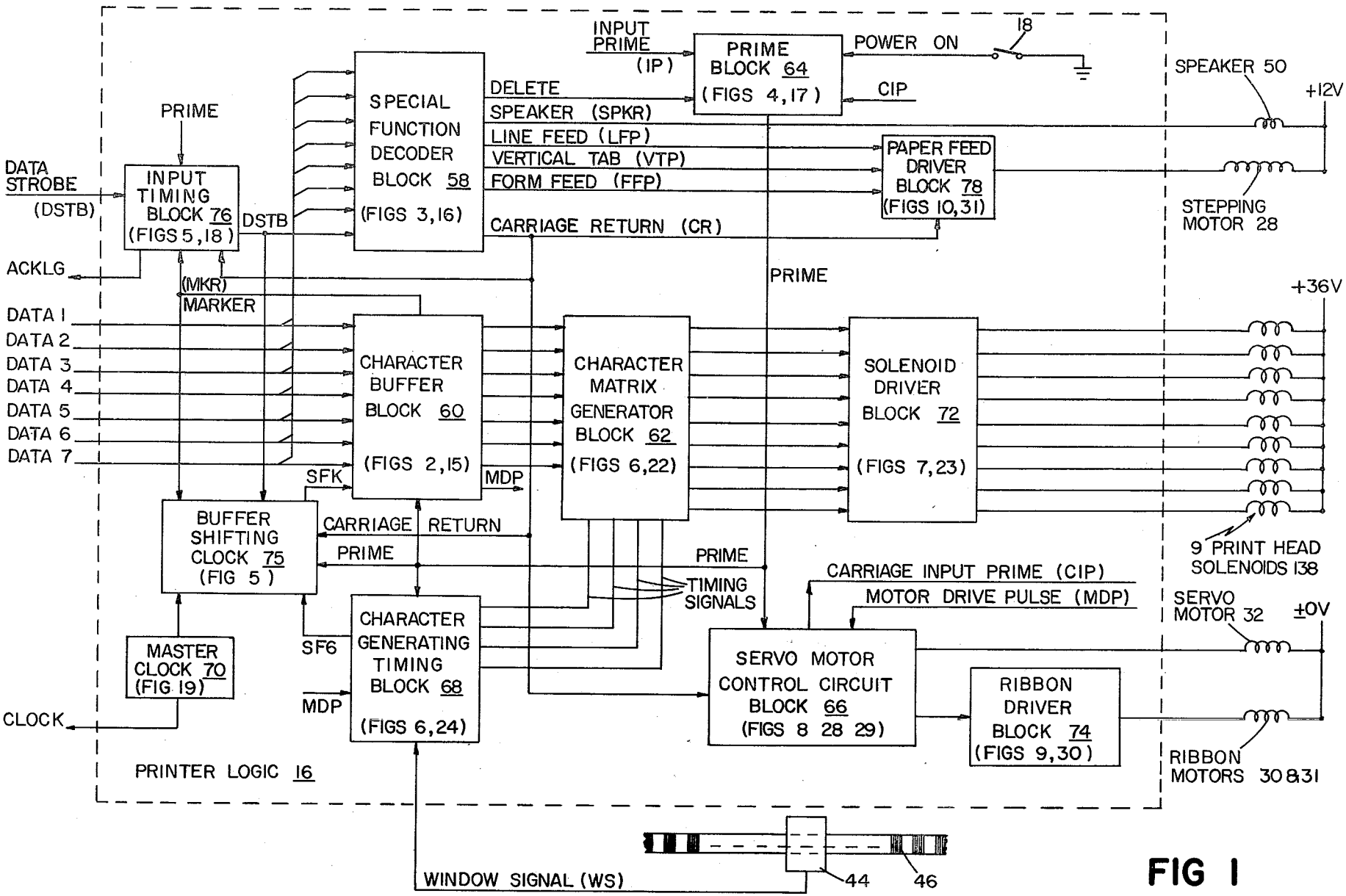
FIG. 1 is a block diagram of the Printer Logic of a printer according to the invention.

Referring again to FIG. 34, the operation of the printer of the invention, including print head 20, is controlled by the printer logic 16, whose principal components are shown in the block diagram of FIG. 1. Printer logic 16 controls a paper feed stepping motor 28 which feeds paper 26 vertically, two ribbon motors 30 and 31, and a servo motor 32 which moves print head carriage 22.

The printer is turned on and off at switch 18. A keyboard 14 includes buttons that control certain operations of the printer and lights that indicate the status thereof. Among the buttons are a Line Feed button 82, which generates a "line feed manual" signal (LFM) to manually feed paper 26, and a Clear button 84, which generates a "clear manual" (CLRM) signal used to reset the status of the printer to an initial condition. The Select Switch button 86 generates a signal indicating that this printer has been selected as an output device, and the button is illuminated to indicate this condition. An alarm light 48 is illuminated to indicate malfunction of the machine, and Speaker 54 emits a noise at the same time to attract the operator's attention.

Feedback information to printer logic 16 is provided by ribbon microswitches 41 and 43, which are actuated by metallic attachments near each end of the ribbon and which cause the ribbon motors 30 and 31 to reverse the direction of travel of the ribbon. A tachometer 42 is connected to servo motor 32 to provide information about the speed of the servo motor. Three microswitches 36 (left margin), 38 (slow return), and 40 (right margin) are actuated by print head carriage 22 and provide information about its position. An optical sensor 44, carried with carriage 22, detects alternate opaque and transparent portions of "fence" 46 (described in detail in U.S. Pat. No. 3,703,949 referred to above) and provides a corresponding signal used to time the printing operation.

The printer logic provides "busy," "acknowledge" and "select" signals to CPU 12 to indicate the status of the printer.

Referring now particularly to FIG. 1, which is a block diagram of printer logic 16, CPU 12 provides data, in the form of 7-bit character codes, to printer 10, and provides a "data strobe" (DSTB) signal to the Input Timing Block 76 to signal the presence of data. Under the control of Input Timing Block 76 and Buffer Shifting Clock 75, the data is shifted into the Character Buffer Block 60. The character codes may represent either printable characters or functions. Function codes are decoded in the Special Function Decoder Block 58, shown also as a block diagram in FIG. 3. Among the function signals output from Decoder Block 58 are the "delete" signal which is input to Prime Block 64, and the signal "speaker" (SPKR) which is used to actuate speaker 50. Other functions signals are three paper feed control signals, "line feed" (LFP), "vertical tab" (VTP), and "form feed" (FFP), which are input to Paper Feed Driver Block 78 to control paper feed stepping motor 28, and a "carriage return" signal, which is input to Paper Feed Driver Block 78 to provide a paper feed during the carriage return, as well as to several other parts of the logic, as will be explained.

A Servo Motor Control Block 66 controls the operation of servo motor 32, and provides an input to Ribbon Driver Block 74, which controls the ribbon motors 30 and 31. The optical sensor 44 scans fence 46 to provide the "window signal" (WS) to Character Generating Timing Block 68. This signal, representing successive column positions, is the basis of the timing of the printing operation.

Under the timing control of Character Generating Timing Block 68, the 7-bit character codes that have been read into the Buffer Block 60 are used as addresses to address the Character Matrix Generator Block 62, which is a read-only memory storing the codes for a 96-character font of dot matrices. Selected matrix codes are input to the Solenoid Driver Block 72, where they are used to control the firing of the nine print head solenoids 138 to print the characters.

The essential operations of the blocks shown in FIG. 1 will be described with reference to a set of block diagrams, FIGS. 2 through 10, and a set of timing diagrams, FIGS. 11 through 14. A set of detailed circuit diagrams are also provided, illustrating by way of example, particular circuits that may be employed to provide the blocks of FIG. 1. The invention will be described in terms of the block diagrams, and the circuit diagrams will not be described in detail, as the functions of the conventional components shown therein are considered to be well understood by those skilled in the art. FIG. 47 shows the functions assigned to certain of the logic elements of FIGS. 15 through 31.

Figure 3:
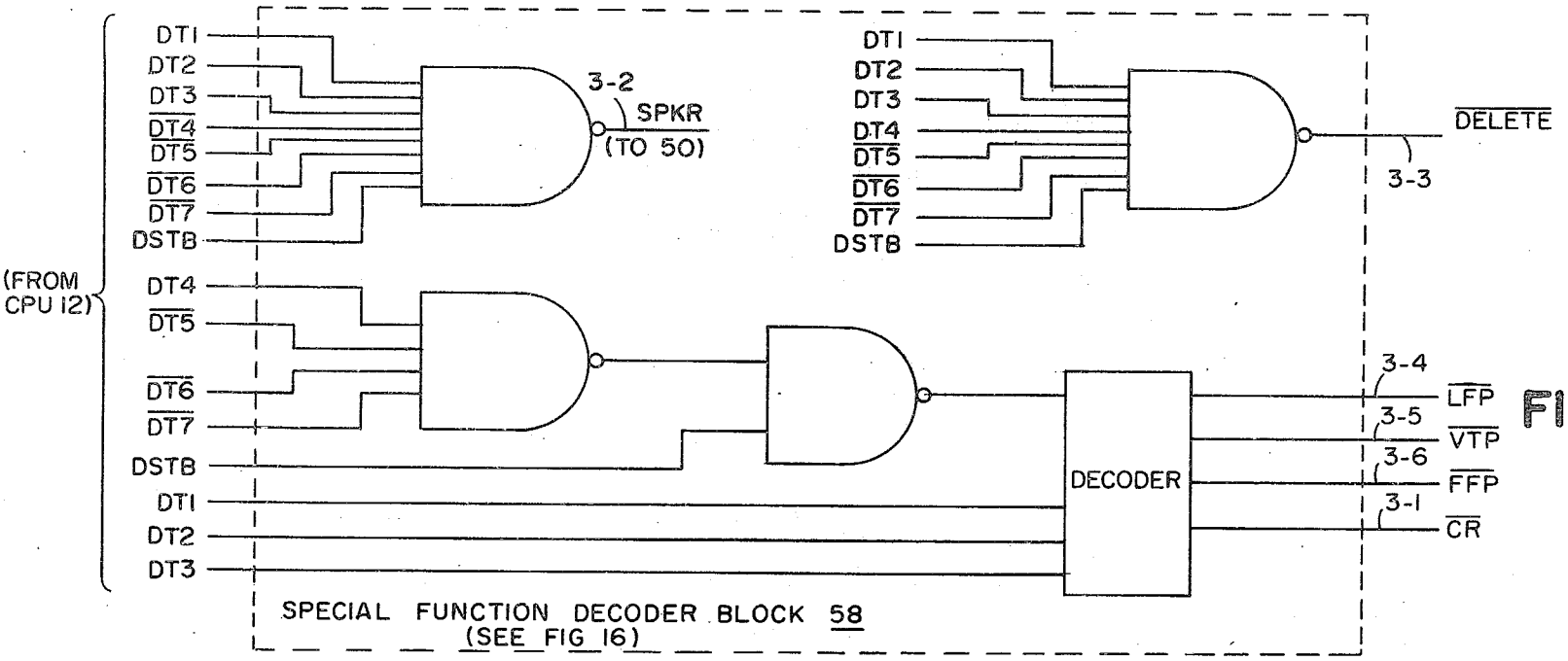
FIG. 3 is a block diagram of the Special Function Decoder Block of FIG. 1.
Figures 15, 16:
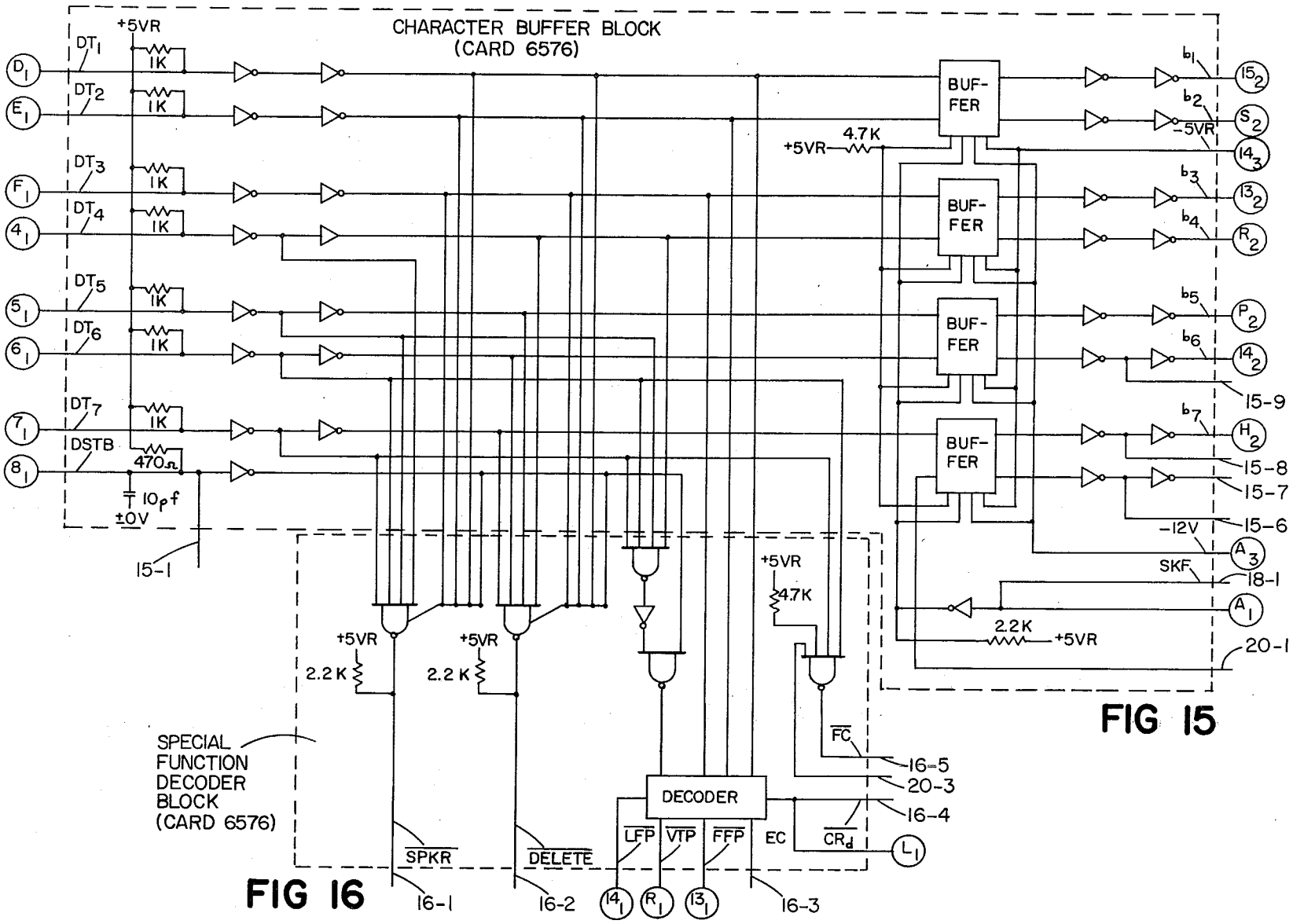
FIGS. 15 through 20 are circuit diagrams of the Character Buffer Block, Special Function Decoder Block, Prime Block, Input Timing Block, Buffer Shifting Clock, Master Clock, and Print Control Block, all of which are located on Card 6576.

The correspondence of the elements of FIG. 1, the block diagrams of FIGS. 2 through 9, and the circuit diagrams of FIGS. 15 through 31, is as follows:

| | Block Diagram | Circuit Diagram |
|---|---|---|
| Special Function Decoder | Fig. 3 | Fig. 16 |

-continued

| | Block Diagram | Circuit Diagram |
|---|---|---|
| Block 58 | | |
| Character Buffer Block 60 | 2 | 15 |
| Character Matrix Generator Block 62 | 6 | 22 |
| Prime Block 64 | 4 | 17 |
| Servo-motor Control Block 66 | 8 | 28, 29 |
| Character Generator Timing Block 68 | 6 | 24 |
| Master Clock 70 | 5 | 19 |
| Solenoid Driver Block 72 | 7 | 23 |
| Ribbon Driver Block 74 | 9 | 30 |
| Buffer Shifting Clock 75 | 5 | 18 |
| Input Timing Block 76 | 5 | 18 |
| Paper Feed Driver Block 78 | 10 | 31 |

Referring now to the block diagrams of FIGS. 2 through 10, the operation of the printer will be described in greater detail.

Figure 5:
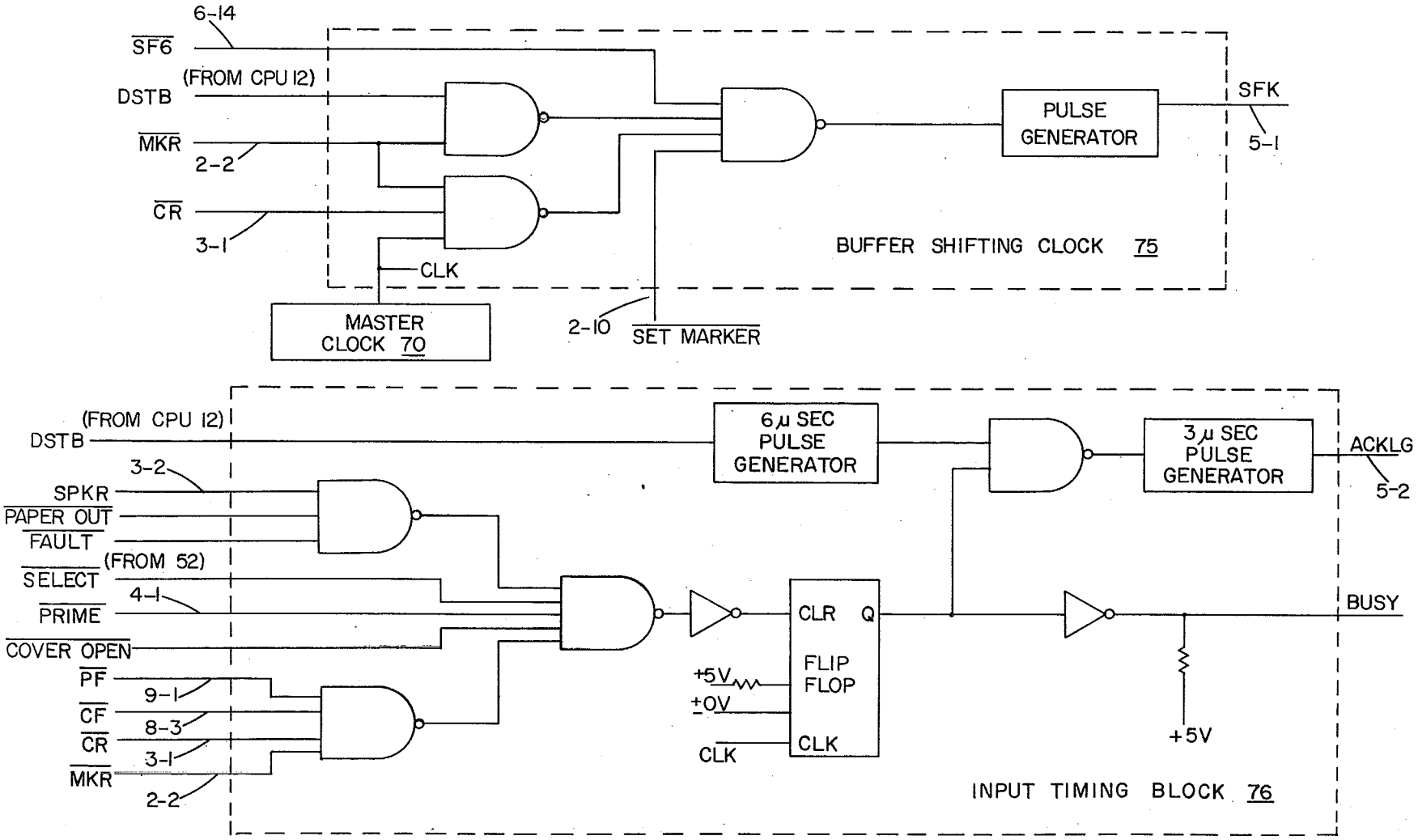
FIG. 5 is a block diagram of the Buffer Shifting Clock and the Input Timing Block of FIG. 1.
Figure 6:
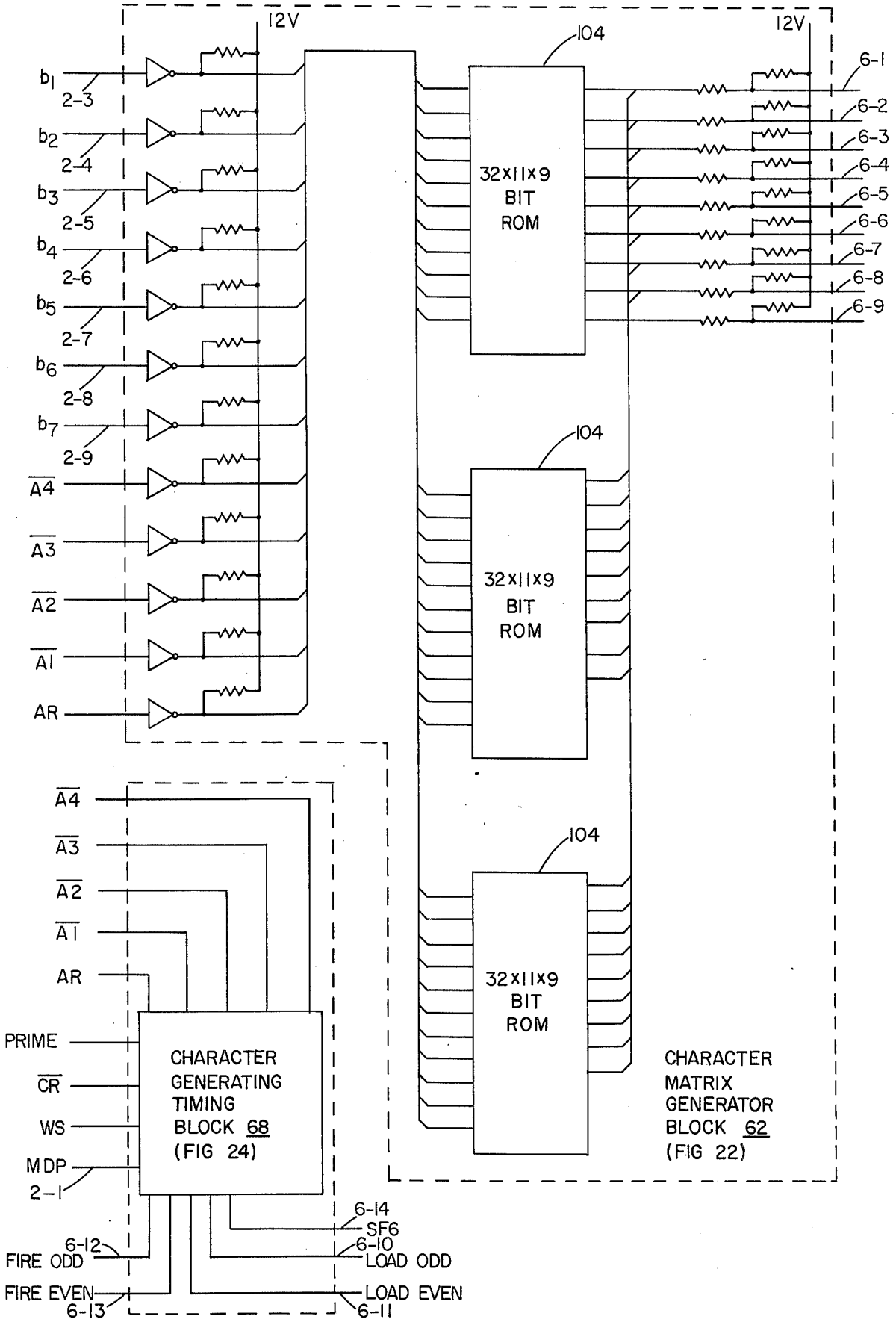
FIG. 6 is a block diagram of the Character Matrix Generator of FIG. 1.

The timing of the reading in of data from CPU 12 to Buffer Block 60 (FIG. 2) is basically determined by the output of Master Clock 70 and the data strobe (DSTB) signal output by CPU 12. Referring particularly to FIG. 5, the Buffer Shifting Clock 75 provides a buffer shift pulse "SFK" at output 5-1 in response to the data strobe pulse. At the same time, the data strobe pulse is input to Input Timing Block 76, where it determines the generation, after a delay, of the "acknowledge" pulse (ACKLG) which is output at 5-2 to CPU 12. The shift pulse (SFK) is input at 5-1 to the Buffer Block 60 (FIG. 2), where it clocks data into the buffer composed of shift registers 88, 90, 92 and 94.

Figure 2:
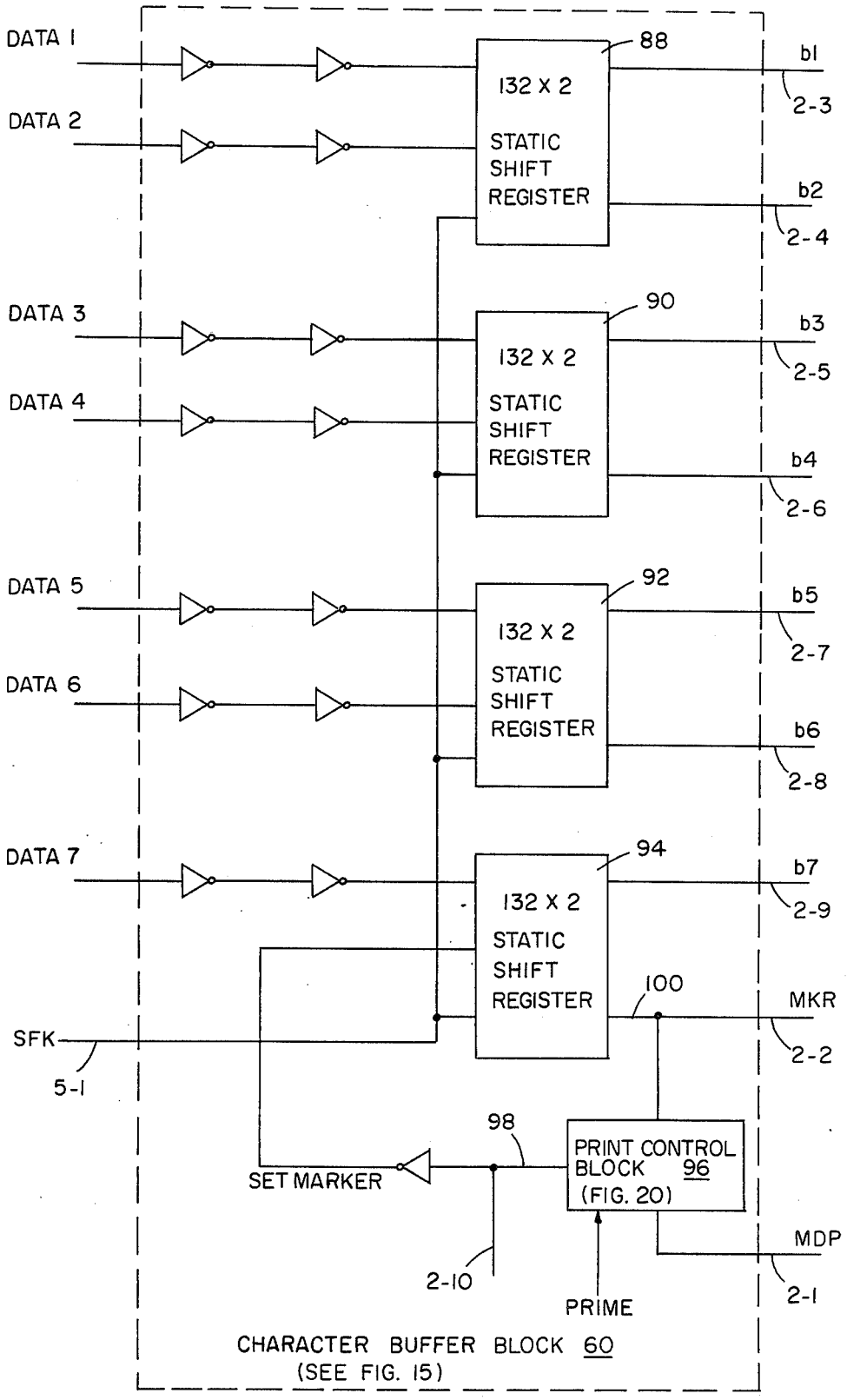
FIG. 2 is a block diagram of the Character Buffer Block of FIG. 1.
Figure 4:
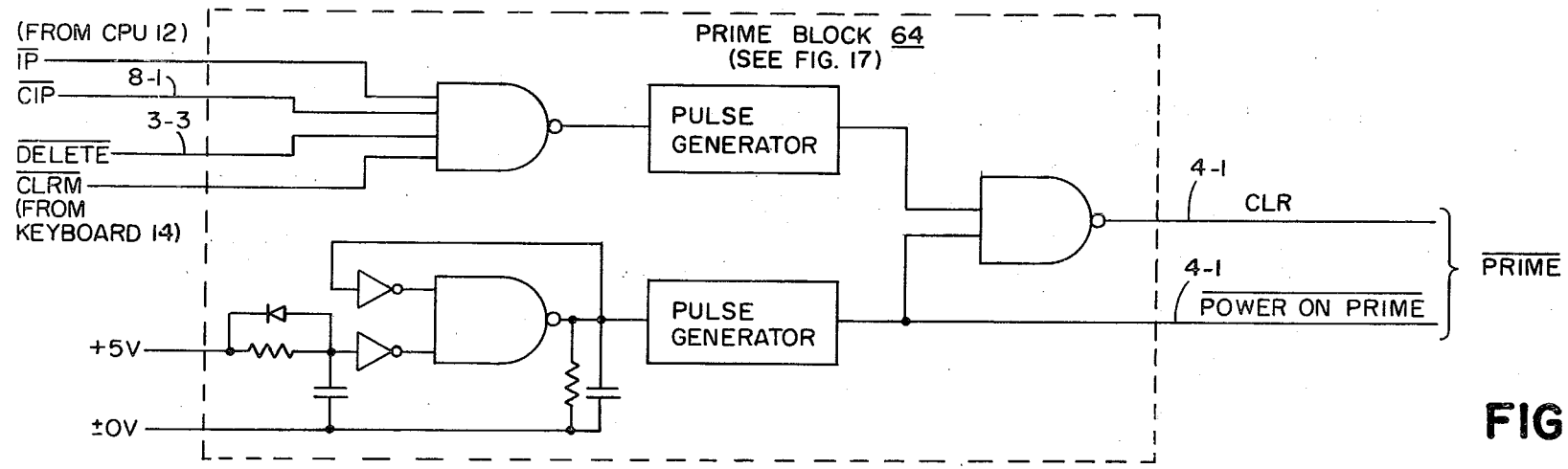
FIG. 4 is a block diagram of the Prime Block of FIG. 1.

Referring to FIG. 4, the printer may be reset to an initial or "primed" condition by being turned on at switch 18 (FIG. 34) (which provides a power input), by an "input prime" signal (IP) from CPU 12, by a "delete" signal from CPU 12, by a "clear" signal (CLRM) from button 84 on keyboard 14 (FIG. 34), or by a "carriage input prime" signal (CIP) generated on the return of carriage 22 to the left margin. To prime the printer in response to any of these conditions, a "prime" signal is generated by the Prime block 64. This signal is input to the Print Control Block 96, which is shown in FIG. 2 as part of the Character Buffer Block 60 and which is shown in detail in FIG. 20. In response to the Prime signal, Print Control Block 96 generates a signal "set marker" on line 98. This signal causes a marker or dummy character to be set into the first position in the buffer. As characters are shifted into the buffer from the CPU, the marker is shifted forward. When 132 characters have been shifted into the buffer, the marker is shifted out at 100, providing a "marker" (MKR) signal that indicates that a complete line of data (132 characters) has been stored in the buffer. In response to the "marker" signal, a motor drive pulse (MDP) is output at 2-1. This pulse is used to start servo motor 32 and to initiate the printing operation. The "marker" signal is also output at 2-2 to the Input Timing Block 76, where it is used to output a "busy" signal to the CPU.

The motor drive pulse (MDP) which is output from Character Buffer Block 60 at 2-1 is input to Servo Motor Control Block 66 (FIG. 8) at 2-1, where it sets the flip-flop 102 to generate a "forward" (F) signal. This signal, combined in the direction control circuit 103 with feedback information from tachometer 42, is used to control the forward motion of servo motor 32, moving carriage 22 across paper 26 during the printing operation.

Figure 24:
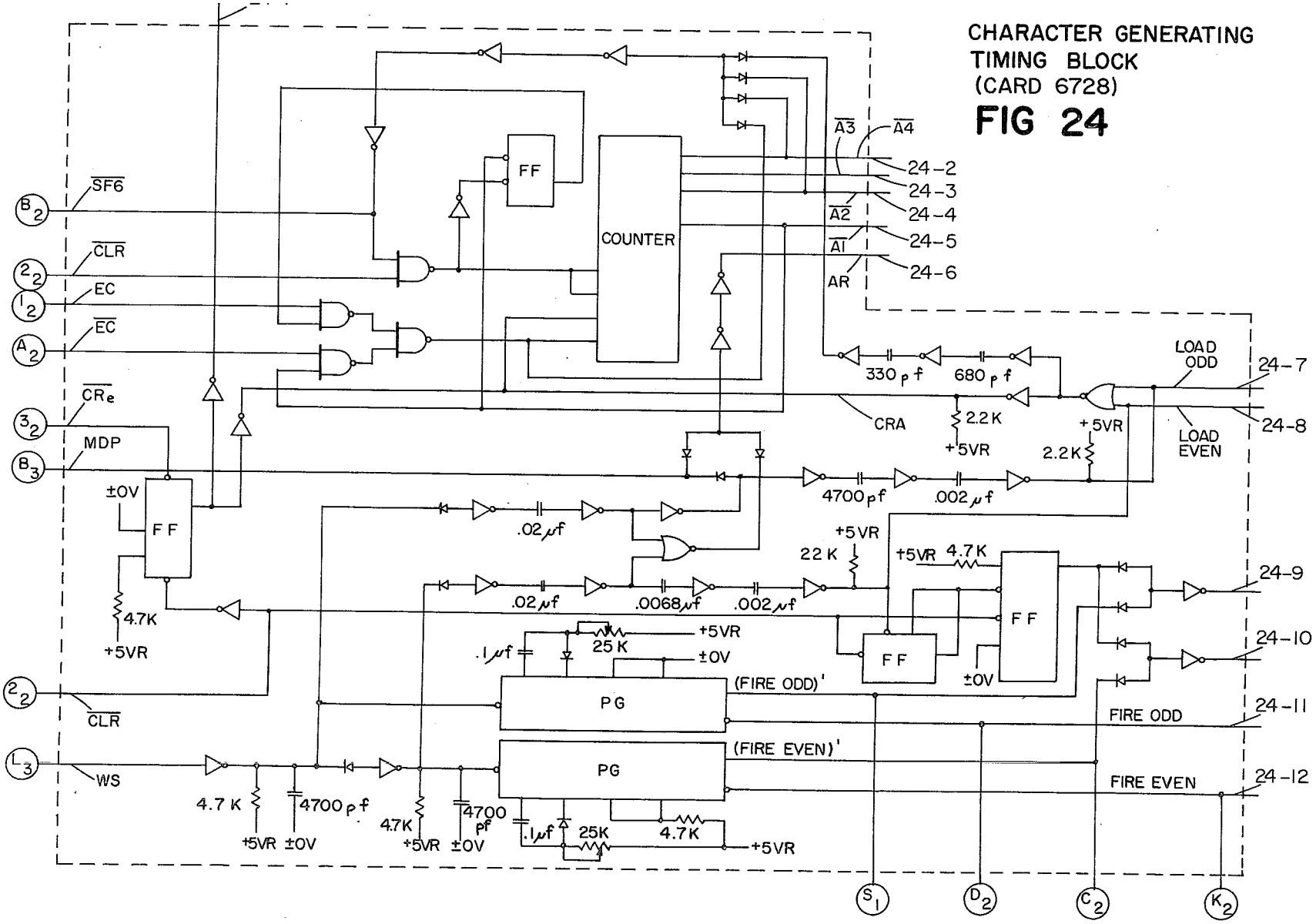
Figure 25:
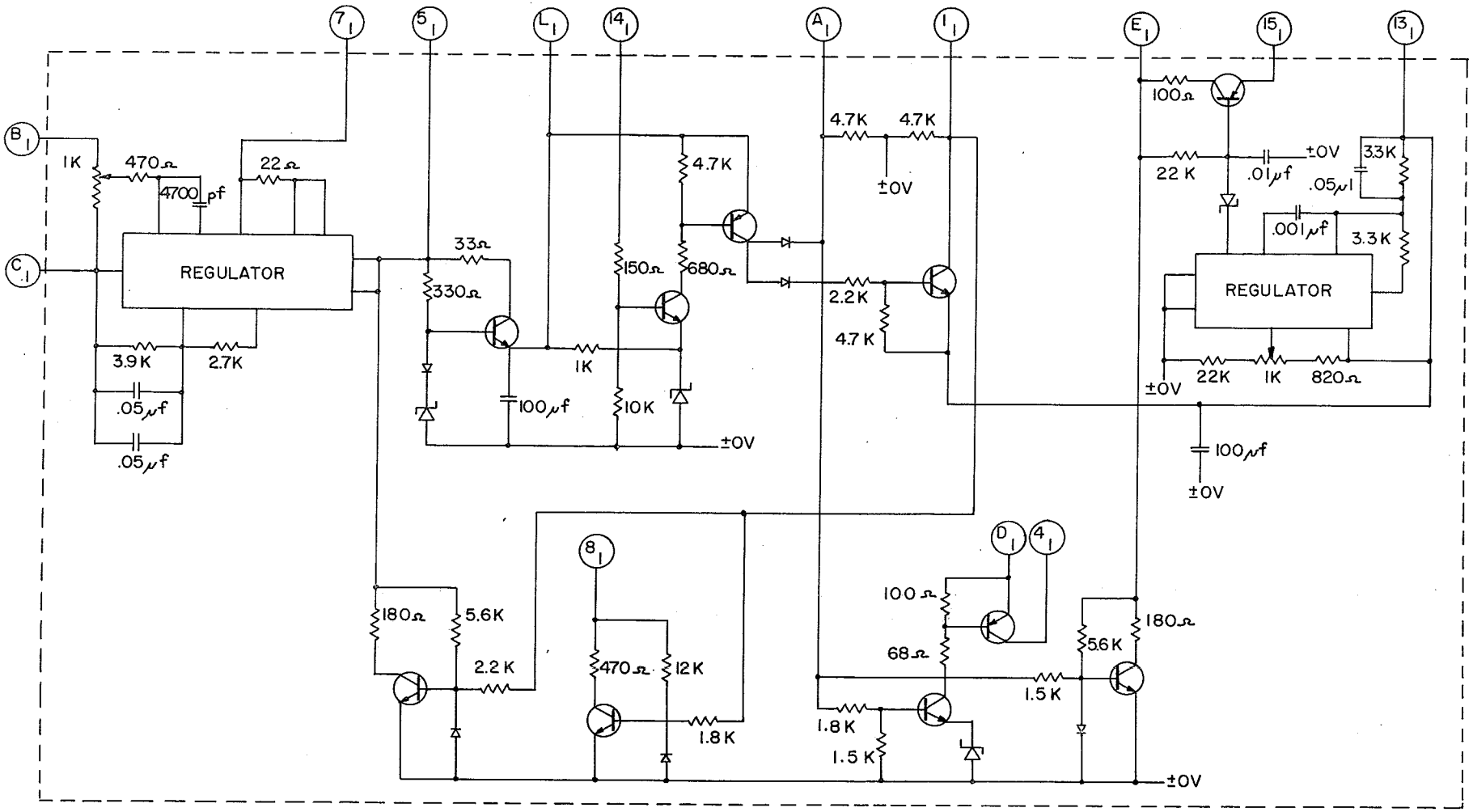
Figures 27, 30:
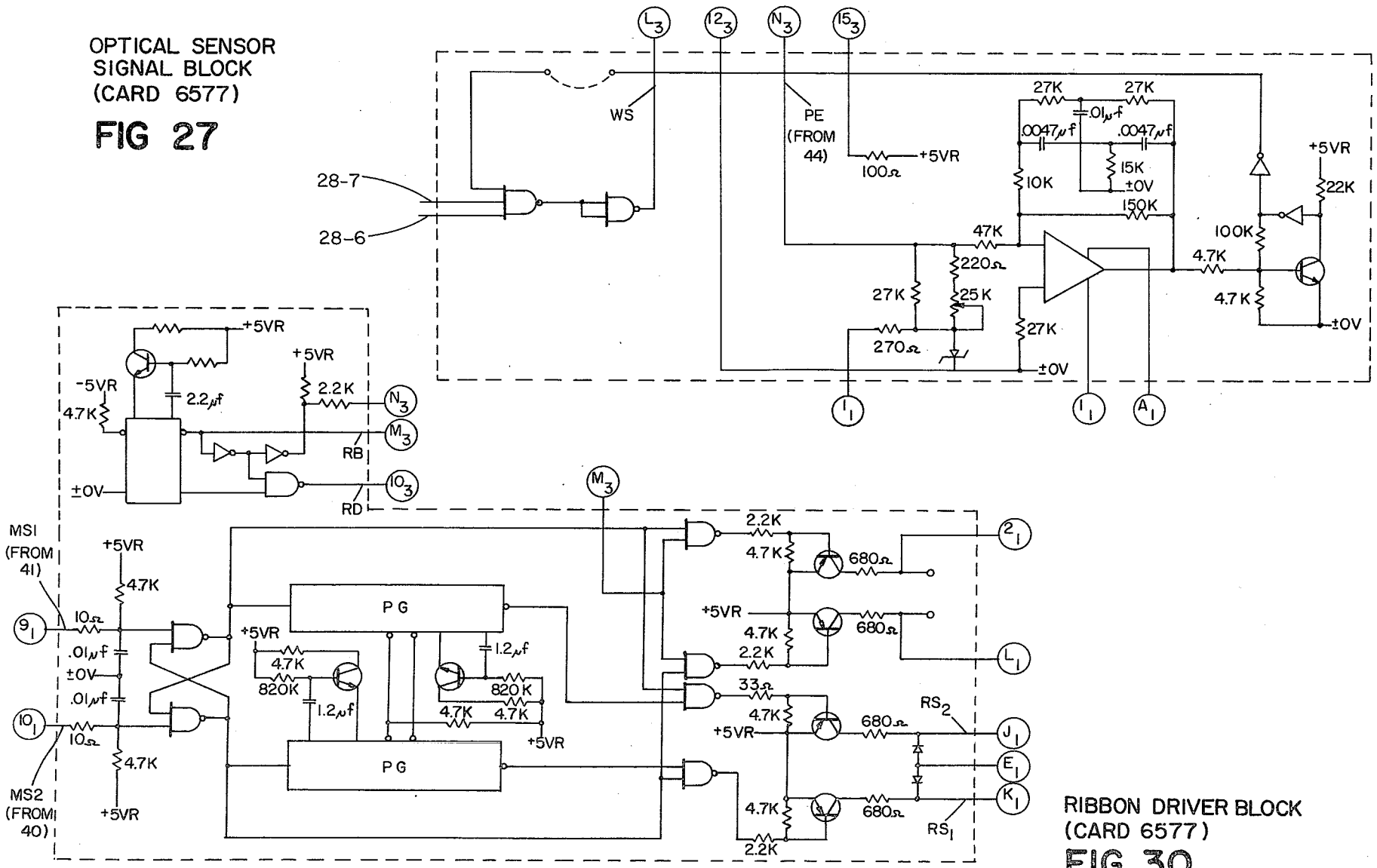
FIGS. 27 through 32 are circuit diagrams of the Optical Sensor Signal Block, Servo Motor Control Block, Ribbon Driver Block, Paper Feed Driver Block, and Format Control Block, all of which are located on Card 6577.
Figure 28:
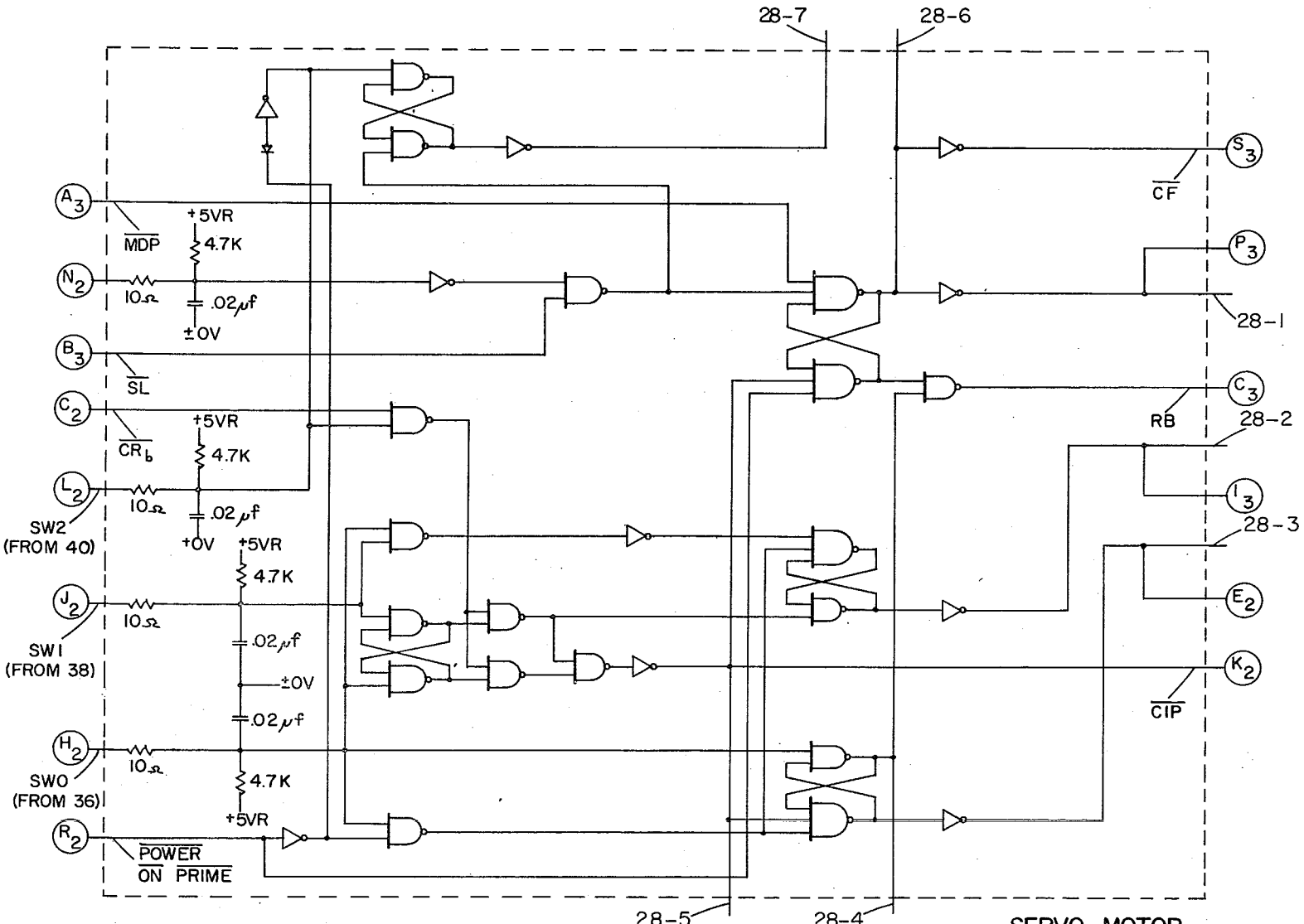
Figure 29:
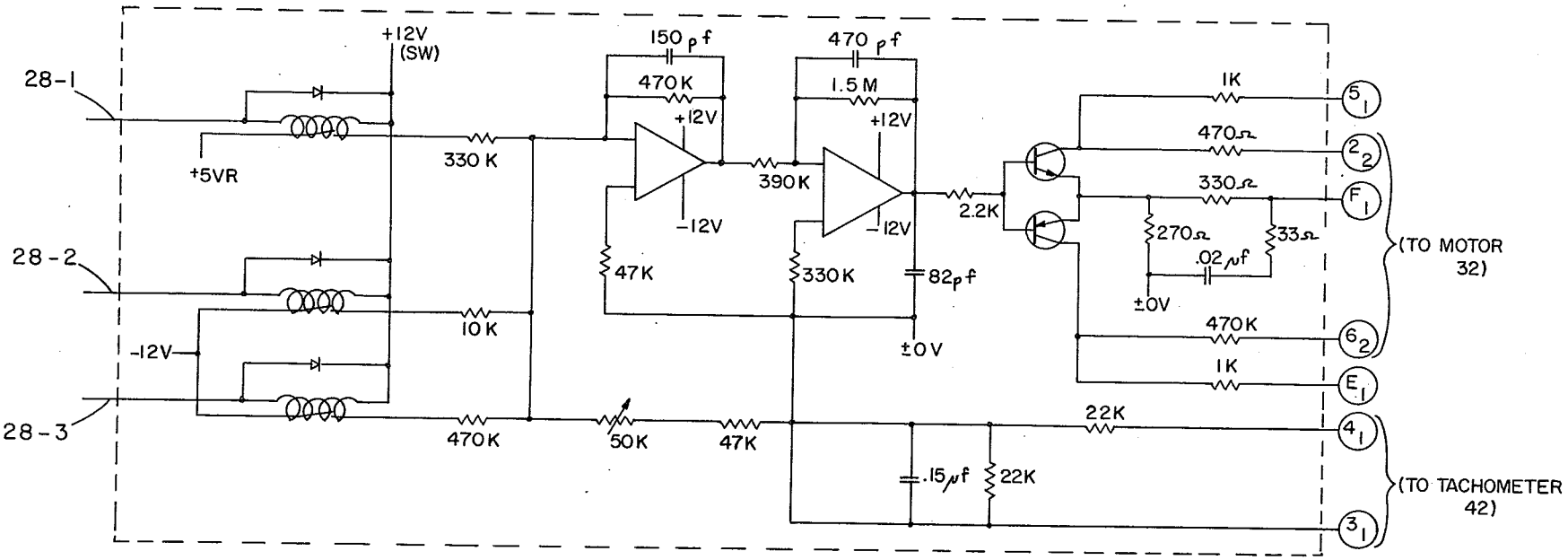
Figure 31:
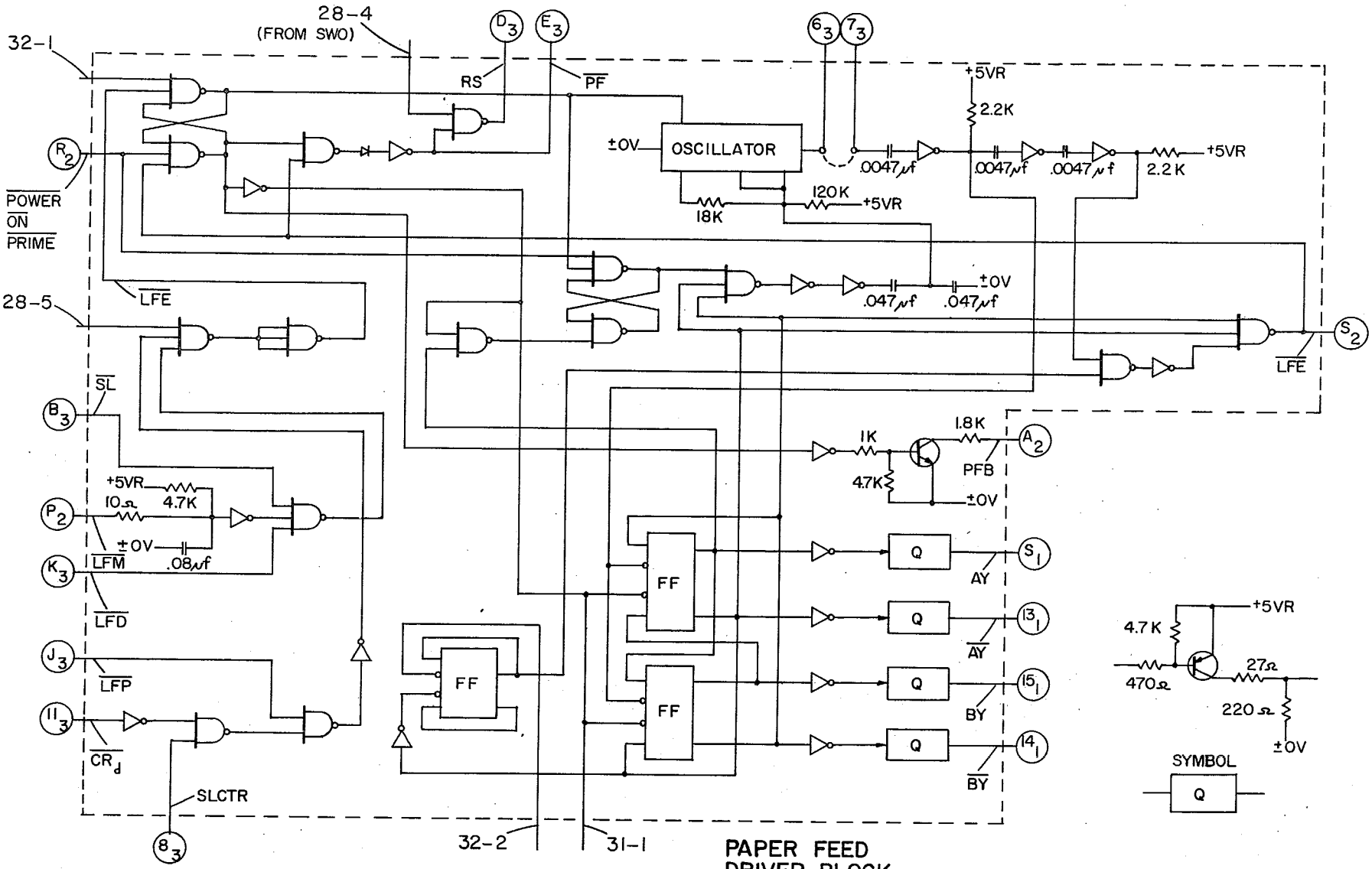
Figure 32:
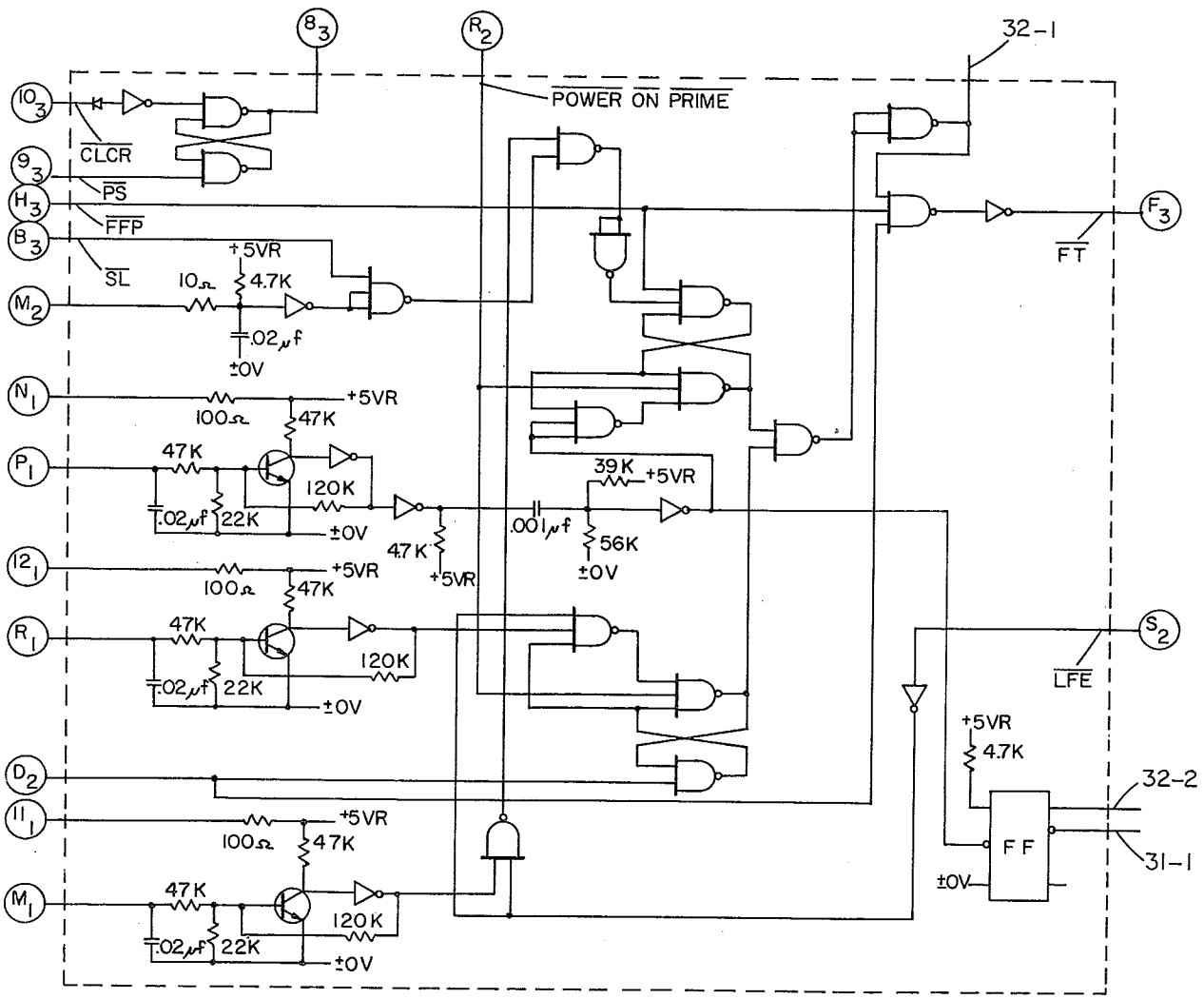

The motor drive pulse (MDP) is also input at 2-1 to the Character Generating Timing Block 68 (FIG. 6), which in response to the MDP signal together with the window signal (WS) from optical sensor 44 generates the timing signals AR, A1, A2, A3, and A4. These signals are shown in the timing diagram of FIG. 12, and an example of particular circuitry to generate appropriate signals is shown in FIG. 24. These pulses determine the reading out of addressed matrix codes from the read-only memory 104 (FIG. 6), which contains 96 matrix codes, each representing an 11-column × 9-row character matrix. The matrix codes are read out (columnwise) on the 9 outputs indicated at 6-1 through 6-9.

The matrix codes are read into Solenoid Driver Block 72 (FIG. 7), where they are shifted through the dot matrix buffers 106-118 under the control of the timing signals "load odd" and "load even," which are derived from the window signal (WS) and are output from Character Generating Timing Block 68 at 6-10 and 6-11. The shifting of codes through buffers 106–109 will be described in more detail in what follows, in connection with the description of the printing of a particular character.

From the dot matrix buffers, the matrix codes are input to multiplexers 120, 122 and 124. Under the control of timing signals "fire odd" and "fire even" (which are also derived from the window signal and are output from Character Generating Timing Block 68 at 6-12 and 6-13) the matrix codes control the firing of the nine print head wire drive devices 138, in a manner also to be more fully described in what follows.

Figure 12:
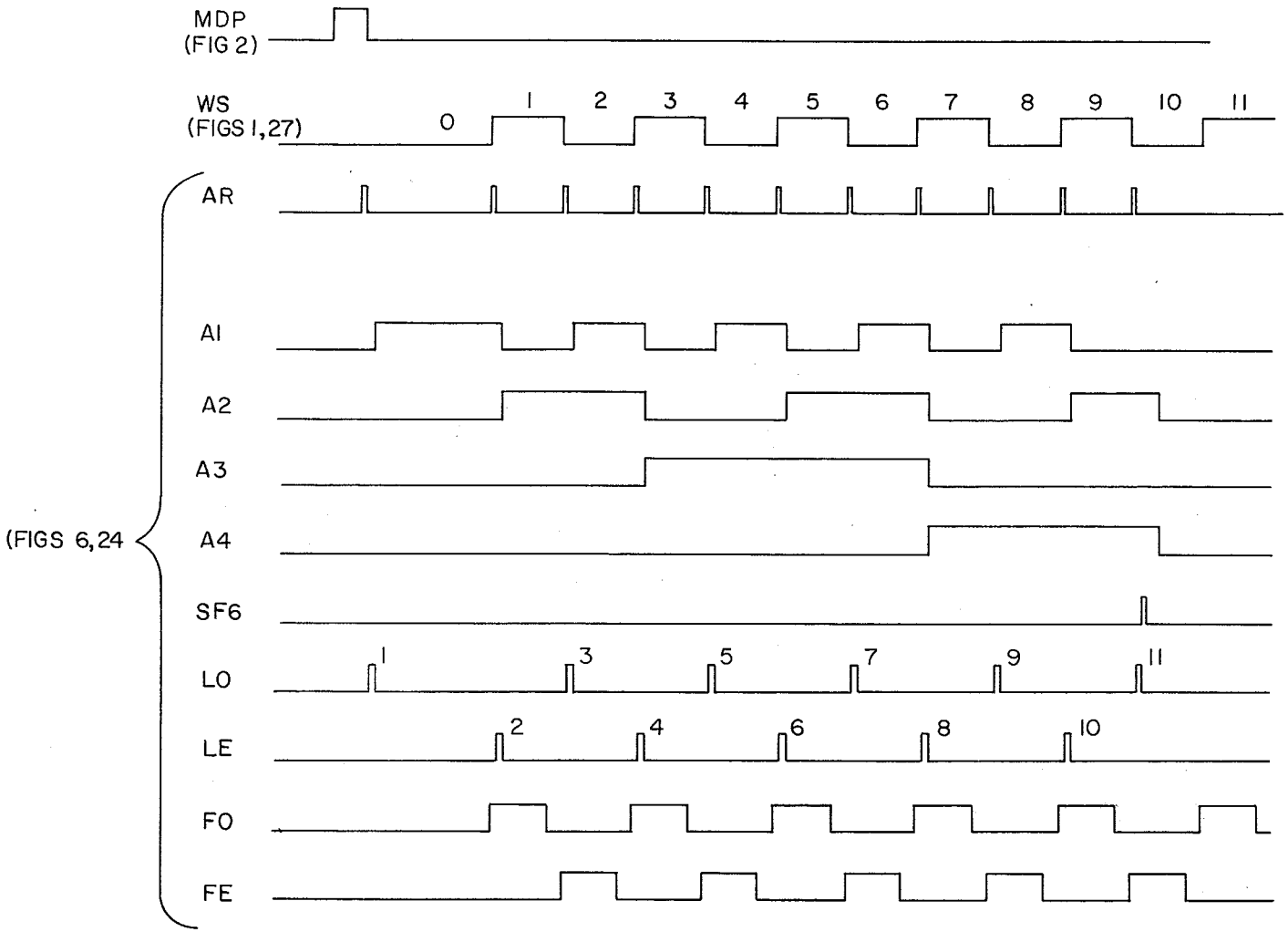
FIG. 12 is a timing diagram of the Solenoid Print Timing.

The "load odd", "load even", "fire odd", and "fire even" pulses are shown in the timing diagram of FIG. 12, and an example of particular circuitry to derive such signals from the window signal is shown in FIG. 24.

A line may contain up to 132 characters. If the line contains fewer than 132 characters, it is terminated by a "carriage return" (CR) code, input from CPU 12, that is decoded in Decoder Block 58 (FIG. 3) and output at 3-1. This signal is input at 3-1 to Servo Motor Control Block 66 (FIG. 8) where it resets the Forward Buffer 102 and sets the Reverse Fast Buffer 126 and the Reverse Slow Buffer 128. The combined outputs of these two buffers (R1 and R2), together with the feedback from tachometer 42, are used to control servo motor 32 to return carriage 22 at high speed toward the left margin. A "carriage input prime" signal (CIP) is generated in response to the carriage return signal and is output at 8-1.

If the printed line contains 132 characters and no carriage return code, the end of the line is signalled when print head carriage 22 actuates the right margin switch 40 (FIG. 34), generating a signal "SW2," which is input to Servo Motor Control Block 66 where it resets buffer 102 and sets buffers 126 and 128 as described above for the carriage return signal. At the same time, in response to the actuation of the right margin switch, a "carriage input prime" signal (CIP) is output at 8-1.

Figure 8:
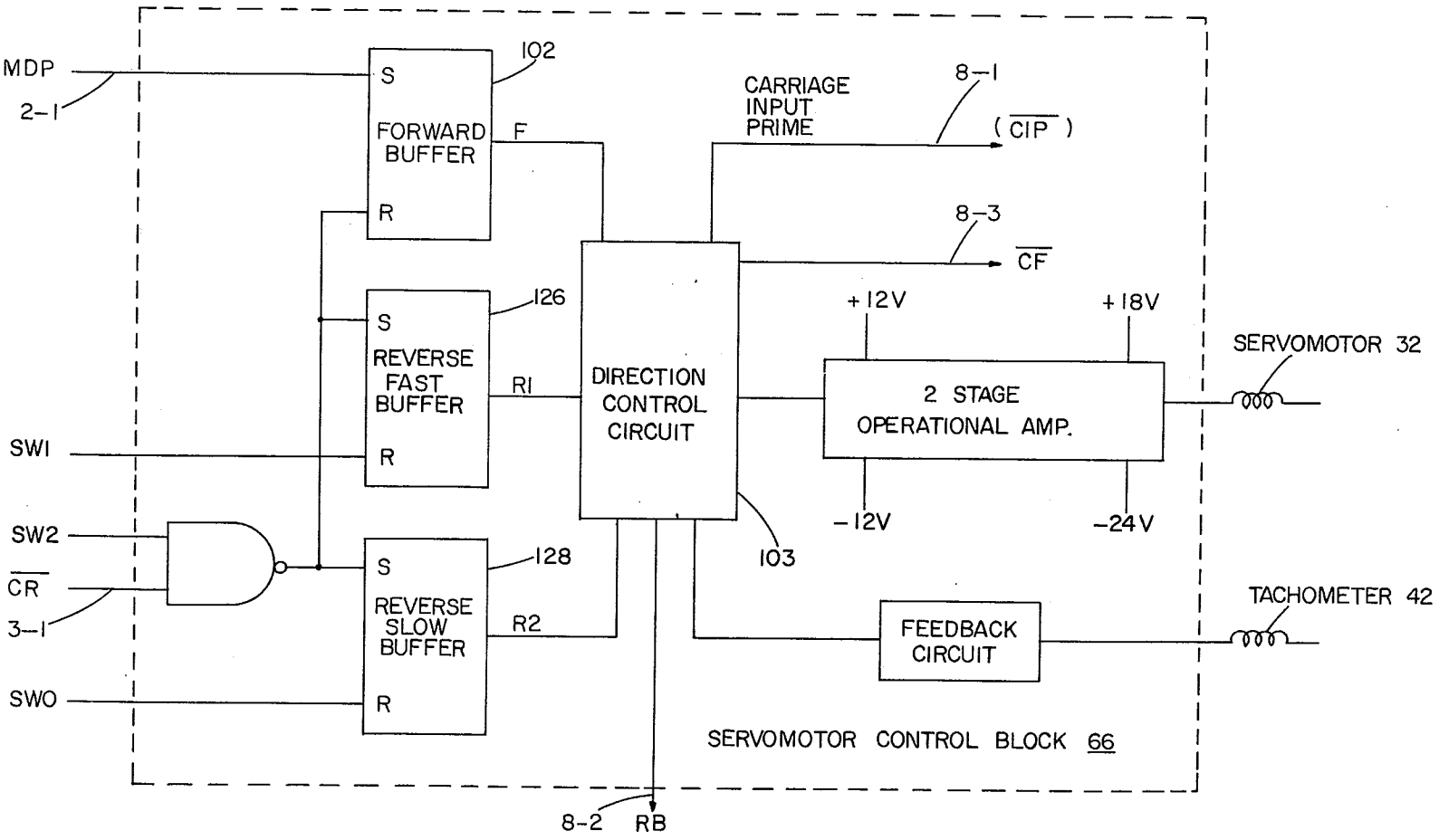
FIG. 8 is a block diagram of the Servo Motor Control Block of FIG. 1.

In either case, the servo motor returns carriage 22 at high speed until carriage 22 actuates slow return switch 38 (FIG. 34), generating a signal "SW1," which resets the Reverse Fast Buffer 126 (FIG. 8). The carriage continues to return at slow speed until it actuates left margin switch 36, which generates the signal "SW0," which resets the Reverse Slow Buffer 128 and thereby stops servo motor 32.

Figure 9:
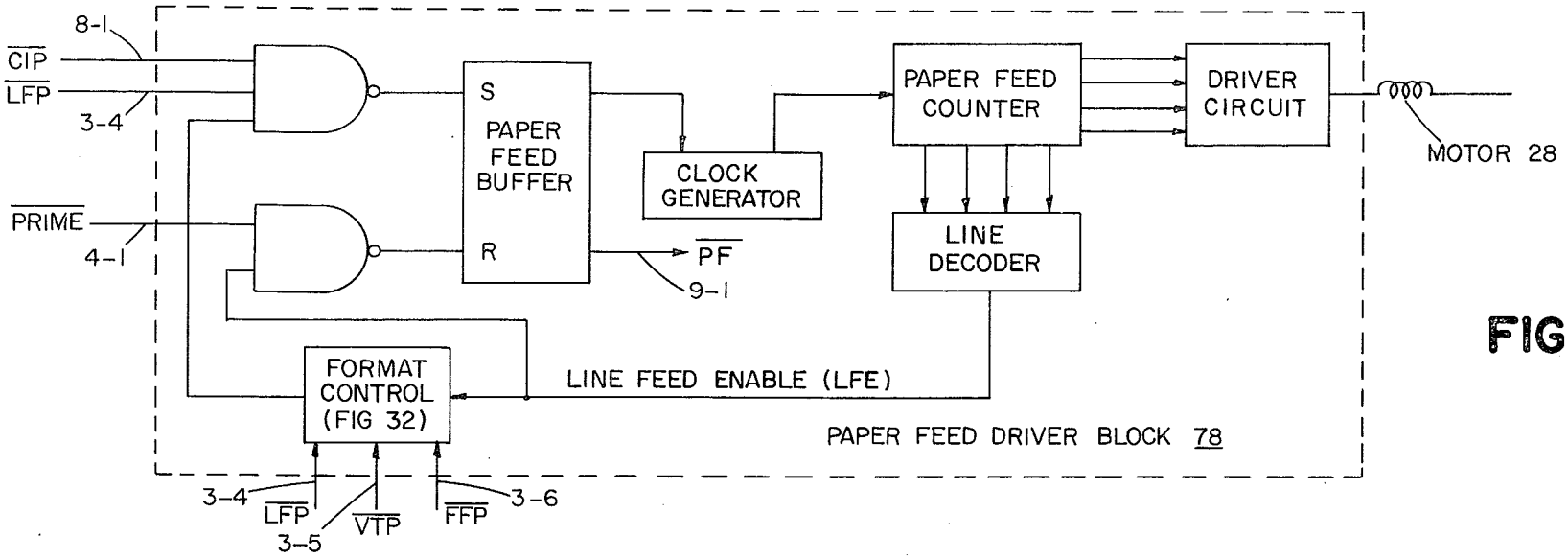
FIG. 9 is a block diagram of the Paper Feed Driver Block of FIG. 1.
Figure 10:
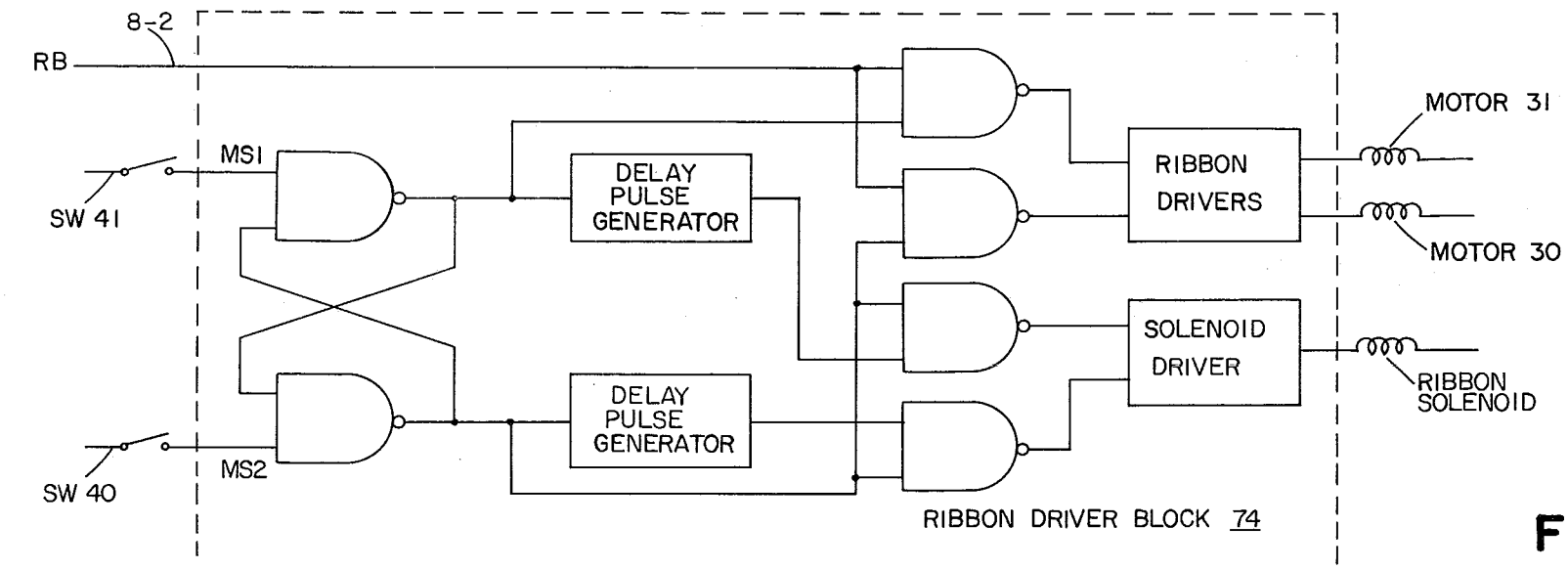
FIG. 10 is a block diagram of the Ribbon Driver Block of FIG. 1.

Of the remaining block diagrams, FIG. 9 shows the Paper Feed Driver Block 78, which controls paper feed motor 28 to feed the paper in response to either a carriage input prime signal, a line feed signal, or a prime signal. A "paper feeding" signal (PF) is generated and output at 9-1; this signal is input at 9-1 to Input Timing Block 76 (FIG. 5), and is one of several conditions resulting in generation of a "busy" signal which is sent to the CPU 12.

Of the remaining inputs to Input Timing Block, not described in connection with block diagrams already discussed, the "carriage moving forward" signal (CF) is generated by the Servo Motor Control Block (FIG. 8) and output at 8-3 when carriage 22 is moving. The "paper out," "fault," and "cover open" signals represent corresponding operating conditions and are generated in a manner well known to those skilled in the art of printing machines. These functions do not form any part of the present invention and therefore will not be described.

The Ribbon Driver Block 74 (FIG. 10) receives a "ribbon drive" signal (RB) from Servo Motor Control Block 66 (FIG. 8) and also receives the "MS1" and "MS2" signals from the ribbon switches 40 and 41, actuated by the ribbon. These signals are used to control the ribbon travel during the printing operation.

The Buffer Shifting Clock 75 will continue to output buffer shift pulses (SFK) in response to the arrival of data from CPU 12, signalled by data strobe pulses (DSTB), until a marker is seen or a carriage return signal is decoded. The carriage return signal causes further "SFK" pulses to be generated to shift the input line of characters forward to the front of the buffer until the marker is read out. The "set marker" input from 2-10 (FIG. 2) causes SFK pulses to be generated in response to a Prime Condition, in order to shift out the buffers to clear them. The "SF6" pulse, generated in the Character Generator Timing Block 68 (FIG. 6) and output at 6-14, is derived from the window signal and is used to generate the "SFK" shift pulse to shift out the buffers character by character during the printing operation.

Timing Diagrams (FIGS. 11–14)

Figure 14:
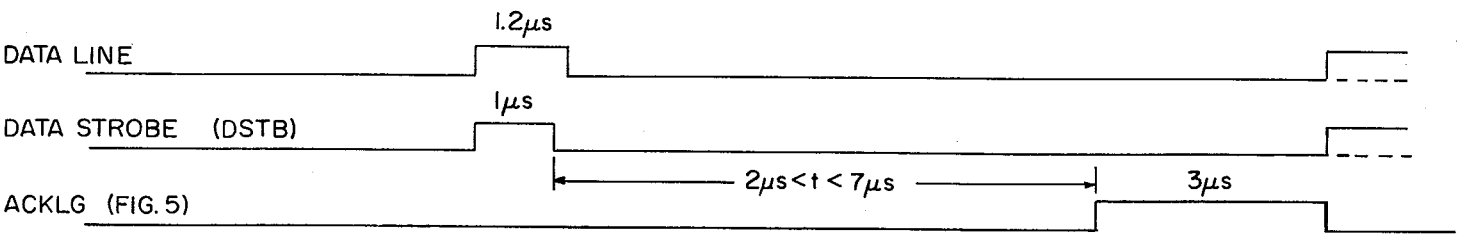
FIG. 14 is a timing diagram of the input of one character to the printer.

Referring now to FIGS. 11–14, the timing diagram of FIG. 14 shows the timing of the input of one character of data to Character Buffer Block 60. The data, in the form of a 7-bit code, is readied for parallel output by the CPU 12, which sends a data strobe pulse (DSTB) to the Input Timing Block 76 of the printer. In response, Input Timing Block 76 generates a buffer shift pulse (SKF) which is output to Character Buffer Block 60 and clocks the data into the buffers. After a time delay, Input Timing Block 76 sends an acknowledge pulse (ACKLG) to the CPU 12.

Figure 11:
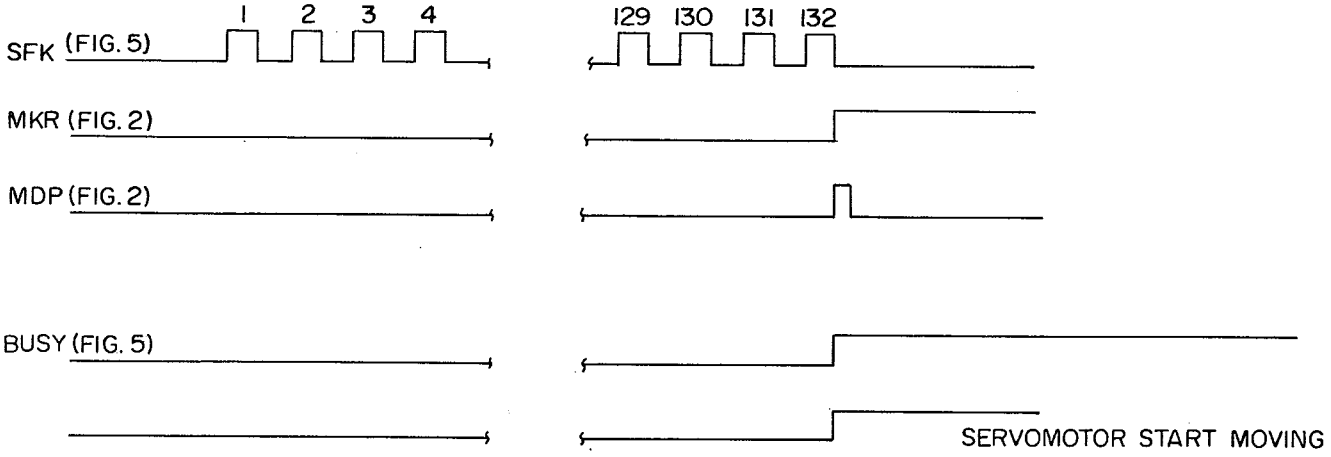
FIG. 11 is a timing diagram of the input of a line of data to the printer.

The timing diagram of FIG. 11 shows the timing of the input of a full line of data to the Character Buffer Block 60. As shown in FIG. 14, shift (SKF) pulses are generated, causing shifting of the buffers of Block 60, until the marker or dummy character, set into the buffer before the data line is read in, is detected. When this dummy character is read out of the buffer, a "marker" signal (MKR) is generated. This signal means that an entire line of 132 characters has been read into the buffer, or that a shorter line has been shifted to the front of the buffer. The MKR pulse causes generation of a motor drive pulse (MDP) and at the same time causes the BUSY signal from the Imput Timing Block 76 to go high (FIG. 5). The servo motor starts to move, in response to the motor drive pulse, conveying print head carriage 22 across the paper 26 to print the line of characters that has been read into the buffer.

The timing diagram of FIG. 12 shows the timing of the printing of a single character. The motor drive pulse (MDP) is input to Character Generating Timing Block 68 and causes the timing signal AR to be initially set high. This condition is used to read out from the read-only memory the matrix code for the first column of the first character. The motor drive pulse (MDP) also causes generation of the initial load-odd signal which loads the matrix code for the first column of the first character into the matrix buffers.

At the same time, the print head carriage is moved forward by the servo motor, until the photo-detector 44 detects the first opaque portion of fence 46, which causes generation of a window signal (WS). In response to the first window signal, representing a first column position, selected print wire drive devices 138 are fired, according to the previously loaded matrix code, to print the first (odd) column of the character.

Further window signals (WS), representing successive column positions, are used to generate further timing pulses (AR) to read out the ROM, and to generate the count levels A1, A2, A3 and A4. In response to the window signal pulses, further load and fire signals are generated, which are used to time loading of the codes for subsequent columns of the character matrix into the multiplexers and firing of appropriate print wire drive devices 138 to print each column, in a manner to be explained in more detail in what follows. The normal character is printed in 9 columns, leaving two columns for the intercharacter space. At the 11th change of state of the window signal (WS), the shift pulse SF6 is generated. This signal is input to the Input Timing Block where it enables generation of a further shift pulse SFK, which is used to shift the next character from Buffer Block 60 to Character Matrix Generator Block 62.

Figure 13:
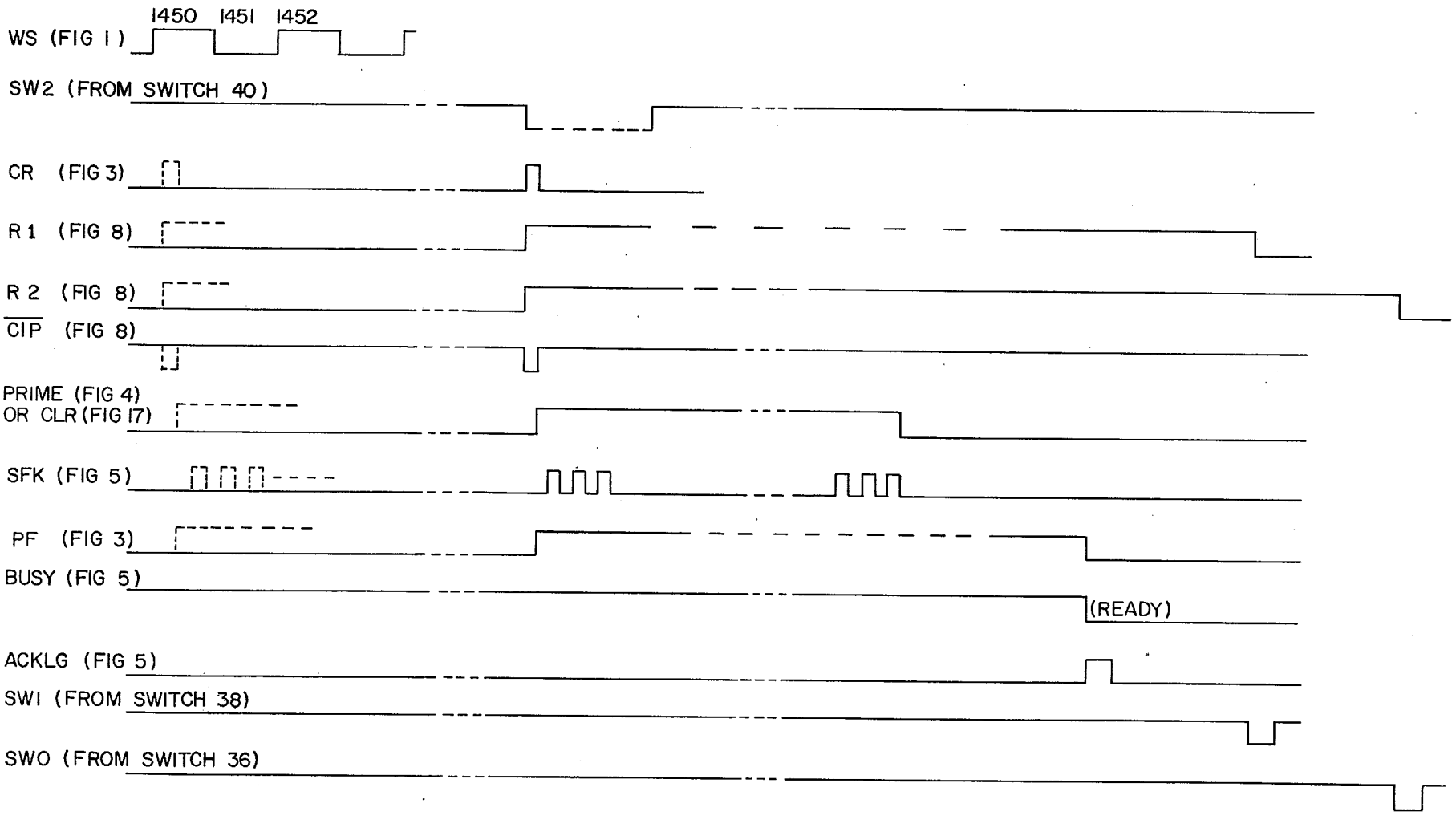
FIG. 13 is a timing diagram of the Servo Motor Control Timing.

Referring now to FIG. 13, which shows the servo motor control timing, the printing of a line may be ended in either of two ways.

In the first case, a carriage return signal is decoded before 132 characters have been printed, and the decoded signal causes output of a CR pulse. These pulses are shown in dashed lines in FIG. 13, together with signals resulting from them. (There is no timing relationship between the decoded carriage return and the window signals as shown in FIG. 13.)

In the alternative case, the window signal (WS) count reaches 1452 (132 characters of 11 columns each), after which the photo detector 44 encounters no further opaque portions in fence 46. The print head carriage continues to move to the right until the right margin switch 40 is actuated by the carriage, generating the "SW2" signal.

Either condition, as shown in FIG. 8, results in the generation of the R1 and R2 signals, which together control the fast return of the print head carriage to the left margin. The fast return continues until the slow return switch 38 is actuated by the carriage, generating the "SW1" signal. This makes the R1 (fast return) signal low, and the carriage thereafter moves at slow speed (R2 high) until the left margin switch 36 is actuated by the carriage, generating the "SWO" signal. In response, the slow return signal (R2) goes low and the carriage stops at the left margin.

The carriage input prime signal (CIP) is generated in response to either the decoded carriage return signal or the right margin switch. This signal goes to the Prime block, where it causes output of a "prime" signal (more specifically, in FIG. 17, the signal CLR), which is used to clear all control buffers.

The carriage return signal (CR) is input to the buffer shifting clock 75, to enable the rapid output of the buffer shift pulses SFK, which cause the buffer to be cleared before the input of the next line.

The paper 26 is automatically fed one line when a CR signal is generated. During the line feed, PF is high. The BUSY level, output from Input Timing Block 76, remains high until the line feed is completed, whereupon the BUSY level goes low and an acknowledge pulse is transmitted to the CPU.

The next line can then be read in from the CPU, beginning while the carriage 22 is moving to the left; the data strobe (DSTB) signal from the CPU initiates the input as illustrated in the timing diagram of FIG. 14.

The slow return switch 38 is actuated by the carriage, shutting off the fast return of the servo motor. Thereafter, the carriage actuates left margin switch 36, which shuts off the slow return. The carriage has reached the left margin.

Circuit Diagrams (FIGS. 15–33)

Particular examples of circuitry suitable for use in constructing the logic of a printer according to the present invention, as described with reference to FIGS. 1 through 14, are shown in FIGS. 15 through 33. The circuitry shown in these figures is shown as physically located on three printed circuit cards of conventional type. The elements of the circuits in the figures are shown in a conventional manner, and include inverters, gates, and integrated circuits. The assigned meanings of particular digital logic symbols used in the circuitry are given in FIG. 47.

Figure 19:
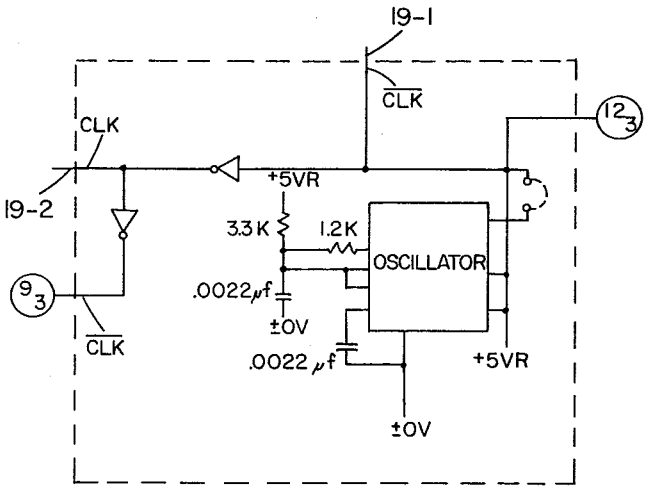
Figure 17:
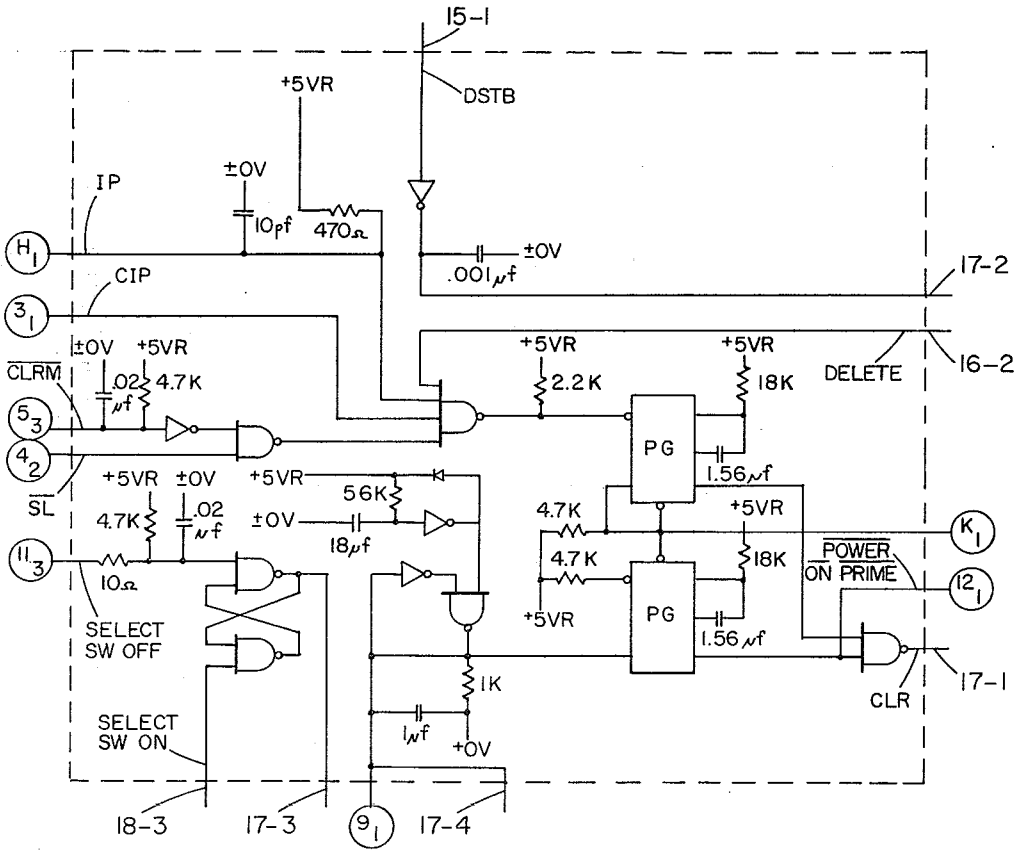
Figure 18:
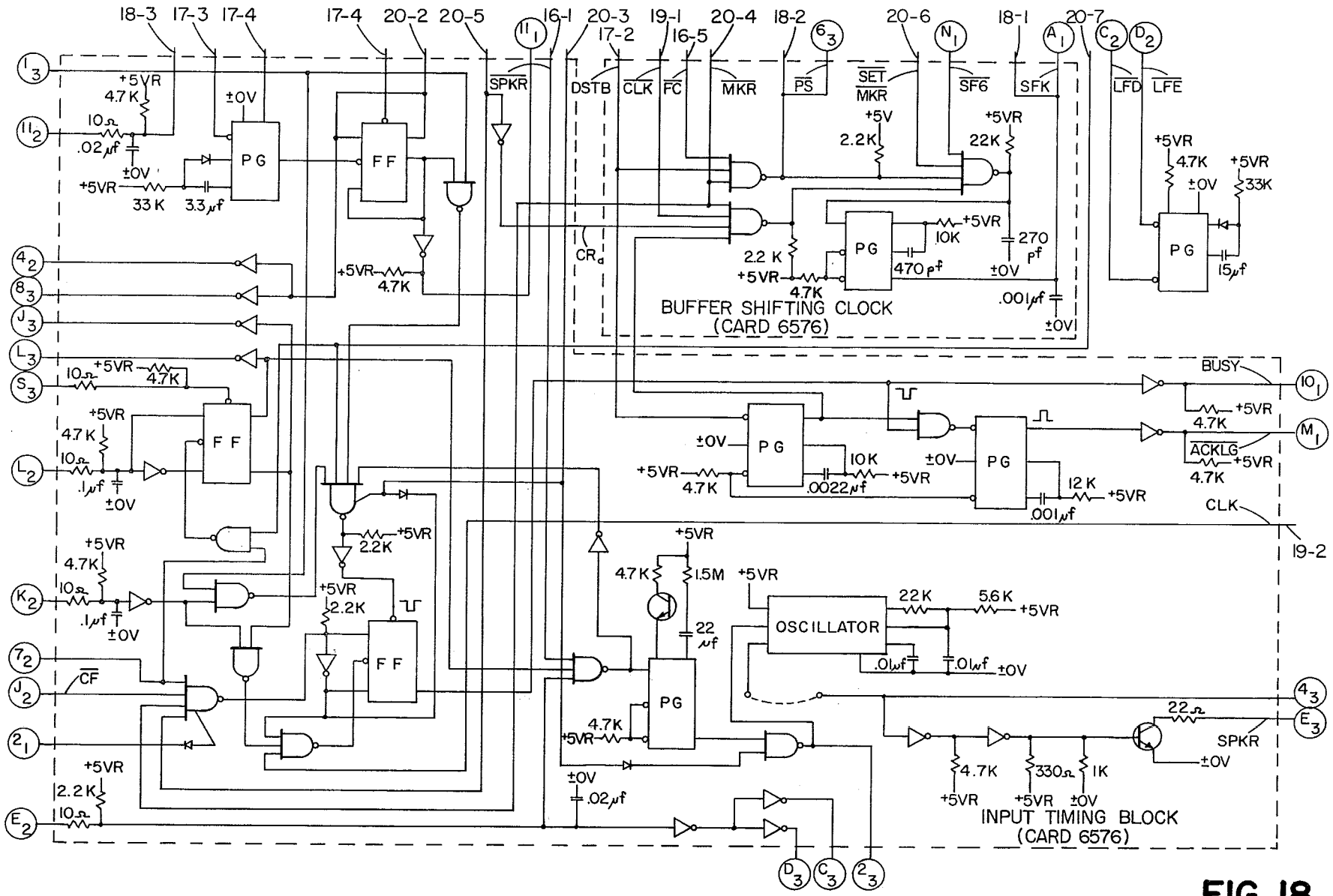
Figure 20:
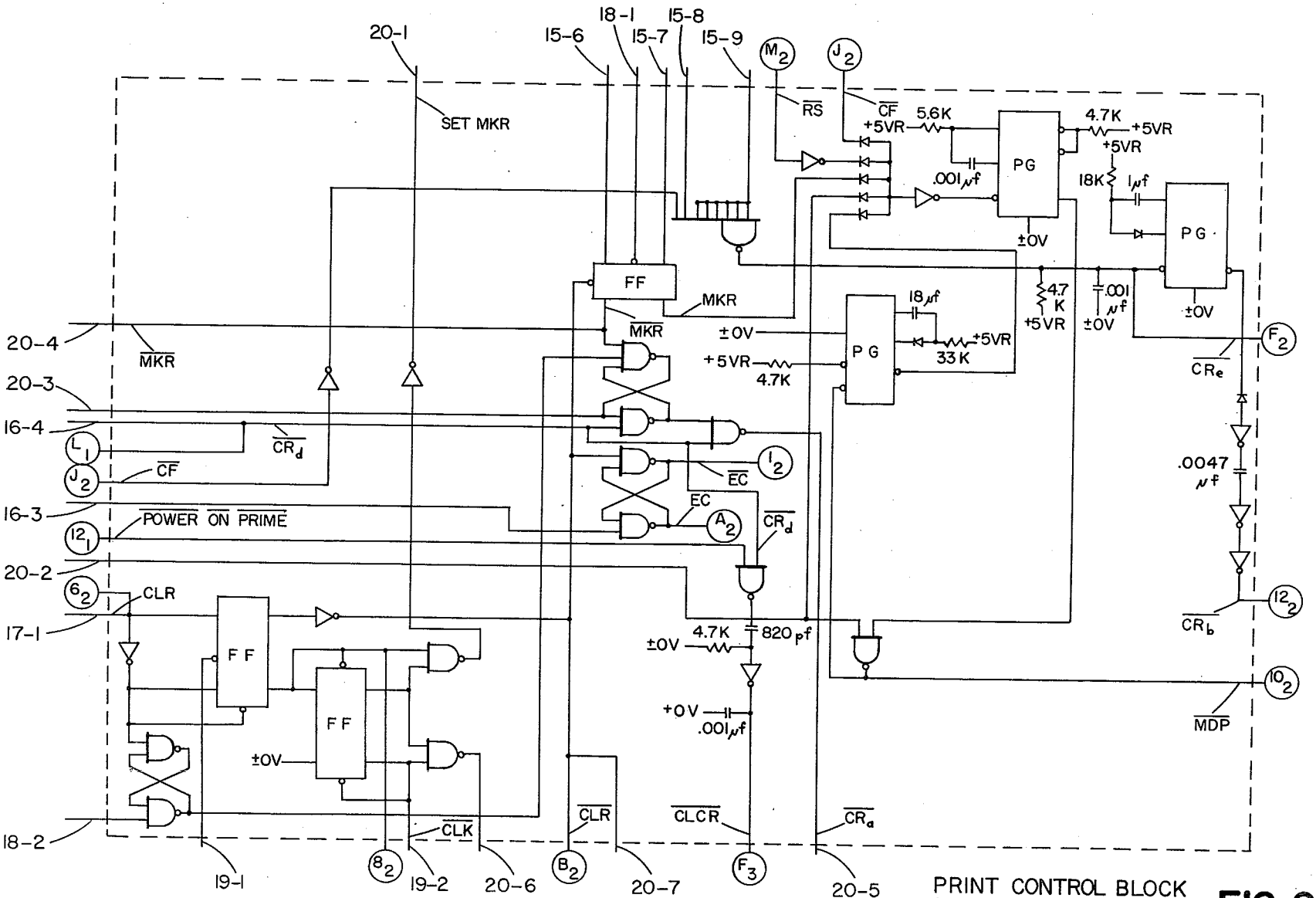
Figure 22:
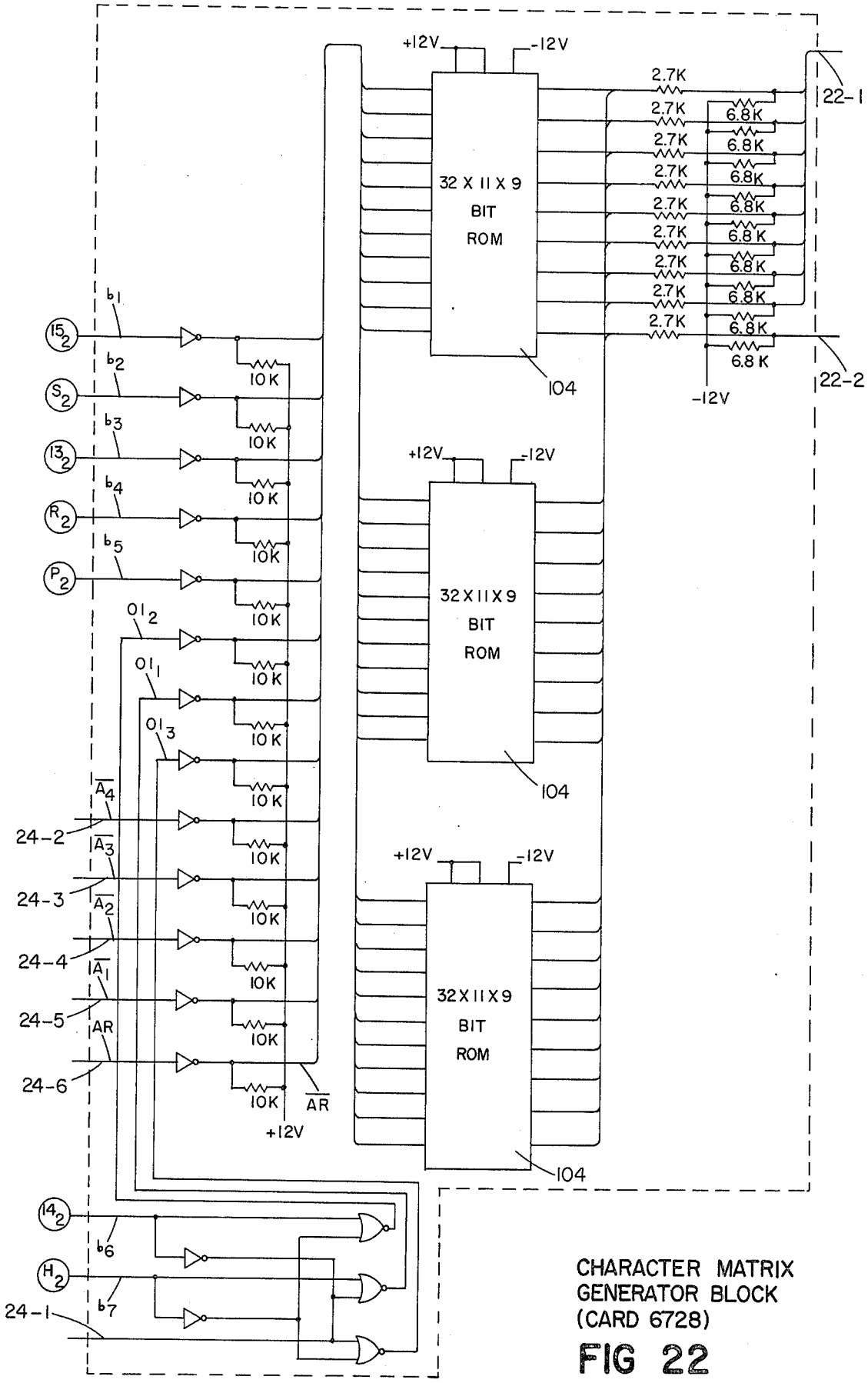
FIGS. 22 through 25 are circuit diagrams of the Character Matrix Generator Block, Solenoid Driver Block, Character Generating Timing Block, and Power Supply, all of which are located on Card 6728.
Figure 23:
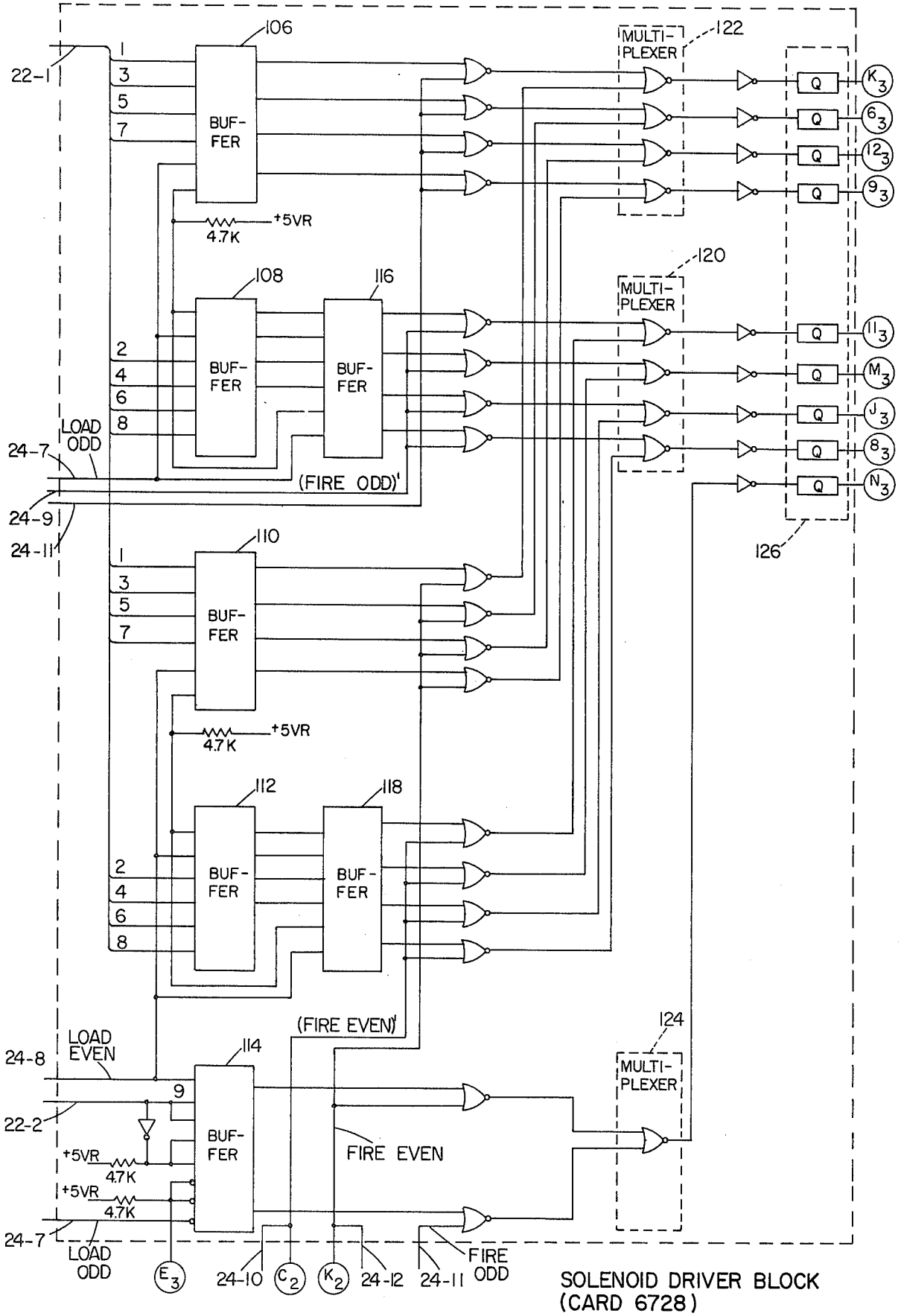

The Character Buffer Block (FIG. 15), Special Function Decoder Block (FIG. 16), Prime Block (FIG. 17), Input Timing Block and Buffer Shifting Clock (FIG. 18), Master Clock (FIG. 19) and Print Control Block (FIG. 20) are shown as located on Card 6576, and FIG. 21 shows the designations of the connectors of this card. Connections among the blocks on this card are designated according to the figure number of the block from which a signal is output; for example, the Master Clock is shown in FIG. 19, and has two outputs, designated 19-1 (signal "CLK") and 19-2 (signal "not-CLK"). The Input Timing Block, shown in FIG. 18, has two inputs labeled 19-1, indicating that these points are connected to the Master Clock output 19-1, and that the signal CLK is input to the Input Timing Block at these points. Other connections may be similarly traced. In addition, designations of particular signals have been given, such as "EC," "SL," etc.

The Character Matrix Generator Block (FIG. 22), Solenoid Driver Block (FIG. 23), Character Generating Timing Block (FIG. 24), and Power Supply (FIG. 25) are located on card 6728, and the connections among these blocks are labeled as has been explained above for card 6576. FIG. 26 shows the designations of the connectors for this card.

The Optical Sensor Signal Block (FIG. 27), Servo Motor Control Block (FIGS. 28 and 29), Ribbon Driver Block (FIG. 30), Paper Feed Driver Block (FIG. 31), and Format Control Block (FIG. 32) are located on card 6577, and the connections among these blocks are labeled as has been explained above for card 6576. FIG. 33 shows the designations of the connectors for this card.

FIGS. 15 through 33 are given by way of example only, and will not be further described.

Character Matrices and Printing Operation

The characters printed by the printer of the invention are each composed of dots positioned on a grid of 11 columns and 9 rows. Normally two of the columns are blank and form the inter-character space. This leaves 9 columns, of which five (1, 3, 5, 7, 9) are termed "odd" and four (2, 4, 6, 8) are termed "even." Each vertical column is composed of nine positions. Of these, the two lowest positions (8 and 9) are used only in printing lower case letters with portions that descend below the line, or for the comma, semi-colon, or underline symbols.

FIG. 47 shows the bearing end of the printer head. There are 9 print wires, arranged in two vertical columns. One column contains "leading" wires 1, 3, 5, 7, and 9; the second contains "trailing" wires 2, 4, 6 and 8.

In the particular embodiment herein described, in which the bearing apertures 147 are 0.0135 inch in diameter and the spacing between axes 145 and 148 is of the order of this diameter, namely about 0.0182 inch, as previously described, the column positions of the printed character matrix are spaced apart by 0.0091 inch, or half the spacing between the axes. This is based upon an output of ten characters per inch, each character having 11 columns of dots, making 110 columns/inch. The print wires have a diameter of 0.013 inch, while the printed image is slightly larger, being about 0.014 to 0.015 inch in diameter.

In high speed printers (printing of the order of 200 characters/second), mechanical limitations, including return time of a print wire, require that no individual print wire 166 be fired at closer intervals than at every other column position, although this may not be true of low speed printers. That is, at least with high speed printers, no one wire can be fired at two adjacent column positions. However, if the leading wires are fired at one column position, the trailing wires can be fired subsequently to print at that same column position, as will be explained. Because the print positions are closely spaced, and the printed image of a dot is slightly larger than the print wire diameter, this provides a substantially continuous vertical printed line, and makes possible the printing of sharp, well defined and legible characters.

Examples of the output of the machine of the invention are shown in FIG. 46.

Referring to FIGS. 35–44, together with FIG. 7 (Solenoid Driver Block 72) and FIG. 12 (Character Print Timing), the successive operations of printing the 11 × 9 character matrix representing the upper case D will be described.

In these figures, the apertures of the print head bearing 146 are seen as though one were looking through print head 20 along wires 166 to paper 26. The apertures are shown in each successive column position at which printing can occur, displaced vertically from the imprinted image but in correct horizontal relationship. In each figure, the apertures 147 are numbered from 1 to 9. The matrix positions are designated by two numbers: an $x$-coordinate running from 1 to 11, representing the columns of the matrix, and a $y$-coordinate running from 1 to 9 (starting at the top of the matrix) representing the rows of the matrix. In each Figure, the printing wires actuated in that particular Figure and the resulting imprinted images are indicated by *x's* within the appropriate dots.

Referring first to the timing diagram of FIG. 12, the motor drive pulse (MDP), generated when a complete line has been stored in Character Buffer Block 60, as has been explained, causes the count level A1 to be initially set high and causes the first "load odd" pulse to be generated. In response, the first matrix code is addressed in the ROM, and the code for the first column of the first character is loaded into buffers 106 and 108 (FIG. 7). The portion of the code input on lines 6-1, 6-3, 6-5 and 6-7 to buffer 106 is used to control firing of the "leading" print wires, while the portion input on lines 6-2, 6-4, 6-6 and 6-8 to buffer 108 is used to control firing of the "trailing" print wires.

The servo motor begins to carry print head carriage 22 across paper 26, and optical detector 44, carried therewith, scans fence 46 until the first opaque portion is detected. In response, the window signal goes high (first change of state).

Figure 7:
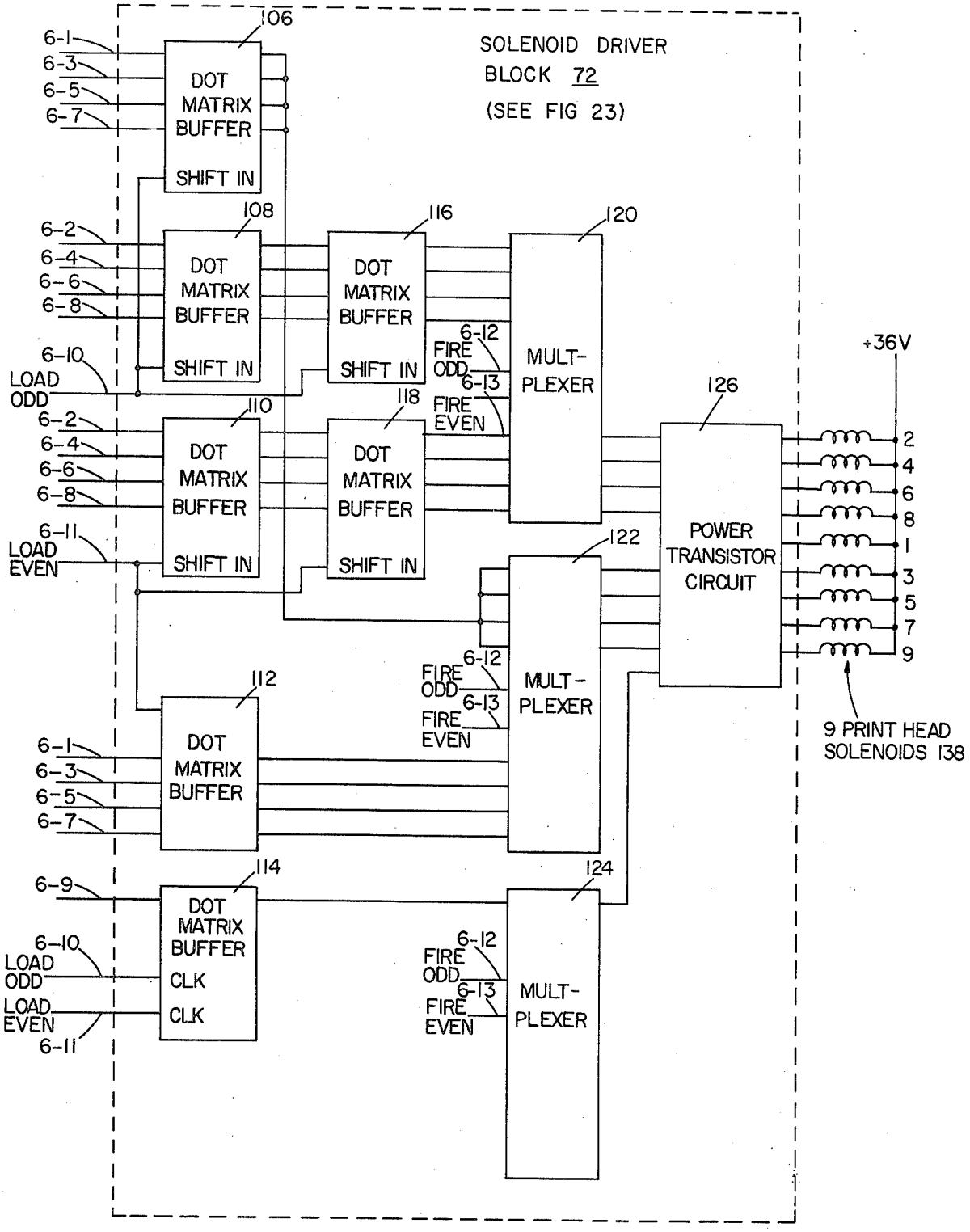
FIG. 7 is a block diagram of the Solenoid Driver Block of FIG. 1.

In response to the window signal, the first "fire odd" signal is generated in Character Generating Timing Block 68, as has been described, and is input to the multiplexers of FIG. 7 at 6-12. The portion of the matrix code that has been loaded into buffer 106 is thereupon output by multiplexer 122 to the power transistor circuit 126 and causes appropriate ones of the leading print wires, in this case wires 1, 3, 5 and 7, to print at the first column position of the character. This step is illustrated in FIG. 35.

At the same time, a "load even" signal is generated, also in response to the first change of state of the window signal, and this causes the code for the second column of the matrix character to be loaded into buffers 110 and 112. The portion of the code input on lines 6-1, 6-3, 6-5 and 6-7 to buffer 112 is used to control the firing of the "leading" print wires, while the portion input on lines 6-2, 6-4, 6-6 and 6-8 to buffer 110 is used to control the firing of the "trailing" print wires.

Figures 35, 36, 37, 38, 39, 40, 41, 42, 43, 44, 45:
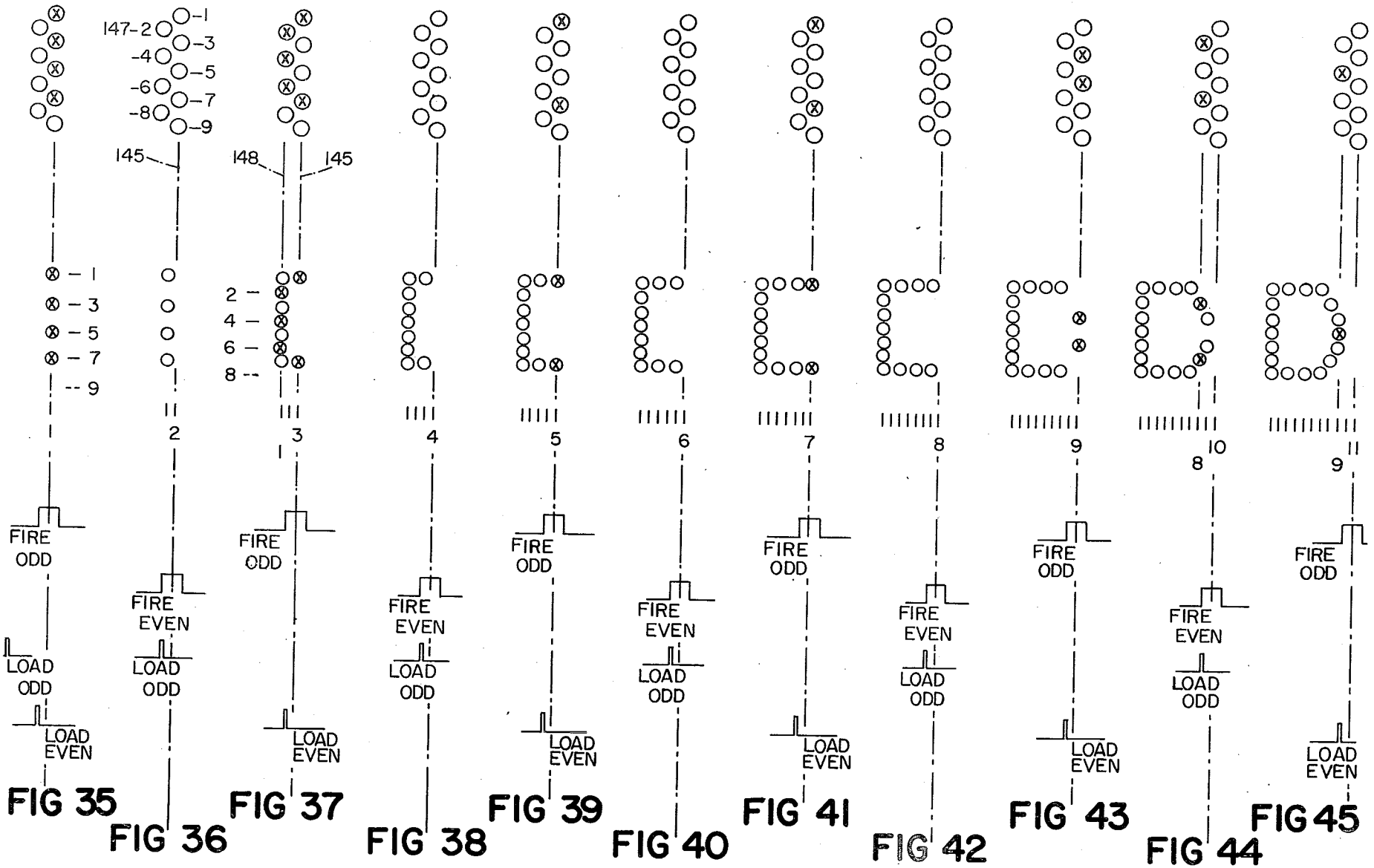
FIGS. 35 through 45 illustrate the successive steps of printing the upper case character D according to the invention.
Figure 51:
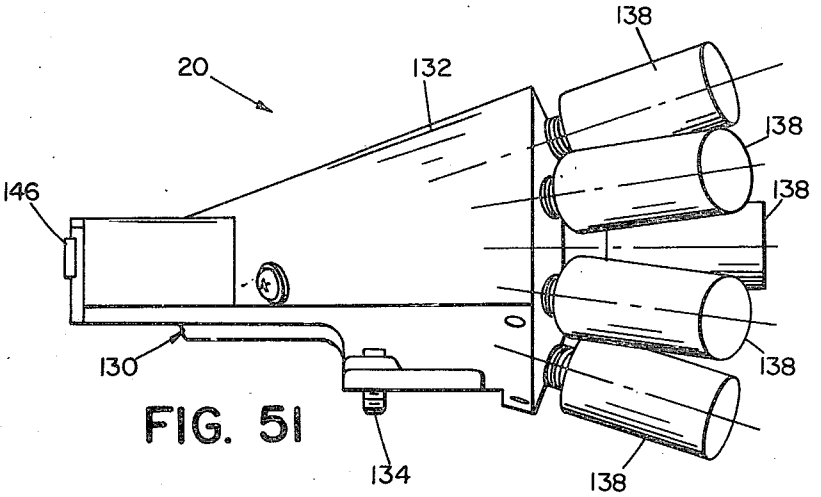
FIG. 51 is an elevation of the print head.
Figure 52:
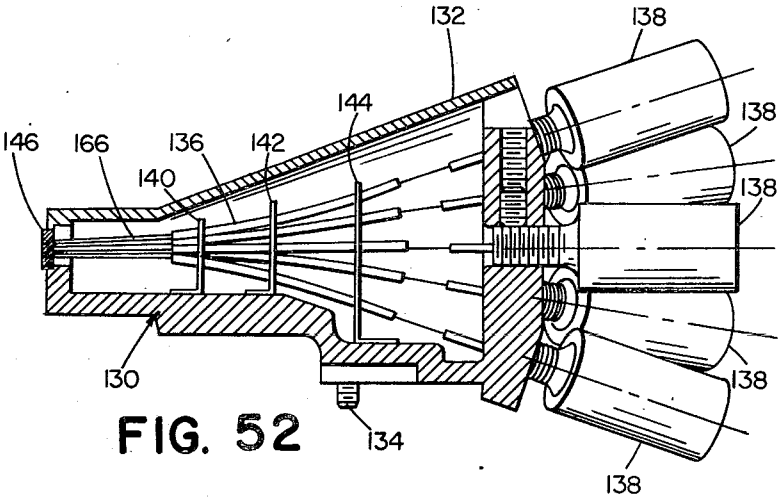
FIG. 52 is a section taken along lines 52—52 on FIG. 51.
Figure 48:
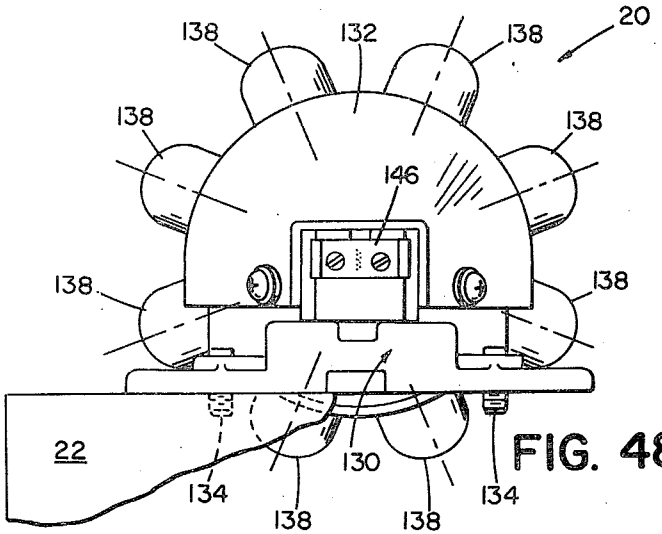
FIG. 48 is an end view of the print head.

Referring now to FIG. 36, servo motor 32 continues to move carriage 22 until the optical sensor 44 detects a transparent portion of fence 46. In response, the window signal goes low, which causes the second "load odd" signal to be generated. This causes the matrix code for the third column of the character to be loaded into buffers 106 and 108, and at the same time causes the code for the trailing print wires of column 1, previously loaded into buffer 108, to be loaded from buffer 108 into buffer 116.

The second change of state of the window signal also causes the first "fire even" signal to be generated in Character Generating Timing Block 68, as has been described, and to be input to FIG. 7 at 6-13. In response, the portion of the matrix code for the second column that has been previously loaded into buffer 112 is thereupon output by multiplexer 122 to power transistor circuit 126 and causes appropriate ones of the leading print wires to print at the second column of the character. In this particular example, since the leading wires 1, 3, 5 and 7 were all fired in column 1, they cannot be fired again in column 2, and the character matrix is so designed that no dots are printed at the second column position. (The ninth wire is used only for characters that descend below the line.).

Referring now to FIG. 37, servo motor 32 continues to move carriage 22 until the optical sensor 44 detects an opaque portion of fence 46. In response, the window signal goes high, which causes the second "load even" signal to be generated, and causes the second "fire odd" signal to be generated, as has been described. The "load even" signal causes the matrix code for the fourth column of the character to be loaded into buffers 110 and 112, and causes the trailing-wire portion of the matrix code for the second column, previously loaded into buffer 110, to be shifted to buffer 118.

The "fire odd" signal causes the code from buffers 106 to be output by multiplexer 122 to power transistor circuit 126, and also causes the code from buffer 116 to be output by multiplexer 120 to power transistor circuit 126. The code from buffer 106 controls the firing of the "leading" wires 1 and 7, which print in column 3, while the code from buffer 116 controls the firing of the "trailing" wires 2, 4 and 6, which print in column 1 simultaneously. This step is illustrated in FIG. 37.

Further load and fire signals are generated in the same manner as has been described. It will be observed that the portion of each column code that controls the firing of the trailing wires is clocked through two buffers while the portion that controls the firing of the leading wires is clocked through one buffer. As a result, when the leading wires are aligned at a particular column position, the trailing wires are simultaneously aligned at the second previous position. Both sets of wires may be fired together only in two even columns or in two odd columns.

Referring again to FIGS. 35 through 44, at FIG. 38 no wires are fired in either column 2 or column 4, while the code for the fifth column of the character is loaded into the buffers. At FIG. 39 the leading wires 1 and 7 are fired and print at the fifth column, while the code for the sixth column is loaded into the buffers. The trailing wires do not fire at column 3. At FIG. 40, no wires are fired at columns 4 or 6, while the code for the seventh column is loaded into the buffers. At FIG. 41, leading wires 1 and 7 are fired in the seventh column, while the code for the eighth code is loaded into the buffers. No trailing wires print at column 5. At FIG. 42, no wires are fired at columns 6 or 8, while the code for the ninth column is loaded into the buffers.

At FIG. 43, leading wires 3 and 5 are fired in the ninth column, while no trailing wires are fired at column 7. At FIG. 44, the leading wires have reached column 10, but no leading wires fire, while trailing wires 2 and 6 fire and print in column 8. The code for the eleventh column is loaded into the buffers.

At FIG. 45, the leading wires at column 11 do not fire, while the trailing wire 4 fires and prints in the ninth column. This completes the printing of the character in eleven steps, although the character dots themselves occupy only nine columns. Columns ten and eleven are blank and form the inter character space.

It will be appreciated that, if desired, the particular timing of the load and fire signals herein described could be adapted to provide that the leading and trailing wires print in adjacent odd and even columns, rather than in two alternate odd columns or two alternate even columns, as herein described.

I claim:

1. In a dot matrix printer head assembly having a plurality of axially movable elongated print wires wire drive means for each of said print wires, comprising a housing having a central opening extending from the front to the rear of said housing a hollow annular shaped opening surrounding a rearward portion of said central opening an annular shaped coil assembly positioned within said annular shaped opening and surrounding the rearward portion of said central opening a cylindrical shaped armature positioned for reciprocating movement within the rearward portion of said central opening so that at least a portion of said armature is surrounded by said coil assembly; said armature having a central through bore enlarged in its forward portion for a substantial distance toward the rearward end thereof the rearward portion of each of said print wires extending into the central opening of an associated one of said driving means through said armature and being joined to the rear end of said armature said print wire outer surface being spaced inwardly from the inner surface of said through bore enlarged forward portion, and a biasing member secured to the rear end of said armature said biasing member normally urging said armature in the rearward direction when said coil assembly is deenergized.

2. Dot matrix printer head assembly wire drive means as claimed in claim 1, further including a hollow cylindrical shaped core element of magnetic material positioned within the forward portion of said central opening so that at least a portion of said core element is surrounded by said coil assembly.

* * * * *